US007590530B2

(12) United States Patent
Zhao et al.

(10) Patent No.: US 7,590,530 B2
(45) Date of Patent: Sep. 15, 2009

(54) METHOD AND APPARATUS FOR IMPROVED ESTIMATION OF NON-STATIONARY NOISE FOR SPEECH ENHANCEMENT

(75) Inventors: David Zhao, Solna (SE); Willem Bastiaan Kleijn, Stocksund (SE); Alexander Ypma, Veldhoven (NL); Bert Devries, Eindhoven (NL)

(73) Assignee: GN Resound A/S (DK)

( * ) Notice: Subject to any disclaimer, the term of this patent is extended or adjusted under 35 U.S.C. 154(b) by 456 days.

(21) Appl. No.: 11/509,166

(22) Filed: Aug. 23, 2006

(65) Prior Publication Data

US 2007/0055508 A1 Mar. 8, 2007

Related U.S. Application Data

(60) Provisional application No. 60/713,675, filed on Sep. 3, 2005.

(51) Int. Cl.
*G10L 21/02* (2006.01)

(52) U.S. Cl. ..... 704/226; 704/233; 704/200

(58) Field of Classification Search ..... 704/222, 704/223, 225, 226, 227, 228, 233, 231, 210, 704/215, 214, 200
See application file for complete search history.

(56) References Cited

U.S. PATENT DOCUMENTS 7,103,541 B2 * 9/2006 Attias et al. ..... 704/226
7,337,113 B2 * 2/2008 Nakagawa et al. ..... 704/233

OTHER PUBLICATIONS

U.S. Appl. No. 60/713,675, filed Sep. 3, 2005, Zhao et, al.
TIA/EIA/IS—127, "Enhanced Variable Rate Codec, Speech Service Option 3 for Wideband Spread Spectrum Digital Systems", Jul. 1996.
I. Cohen, "Noise spectrum estimation in adverse environments: Improved minima controlled recursive averaging", *IEEE Trans. Speech and Audio Processing*, vol. 11, No. 5 pp. 466-475, Sep. 2003.
R. Martin, "Noise power spectral density estimation based on optimal smoothing and minimum statistics", *IEEE Trans. Speech and Audio Processing*, vol. 9, No. 5 pp. 504-512, Jul. 2001.
V. Stahl et al., "Quantile based noise estimation for spectral subtraction and Wiener filtering", in Proc. *IEEE Trans. Int. Conf. Acoustics, Speech and Signal Processing*, vol. 3, pp. 1875-1878, Jun. 2000.

(Continued)

*Primary Examiner*—Huyen X. Vo
(74) *Attorney, Agent, or Firm*—Vista IP Law Group, LLP.

(57) ABSTRACT

A central aspect of the invention relates to a method of enhancing speech, the method comprising the steps of, receiving noisy speech comprising a clean speech component and a non-stationary noise component, providing a speech model, providing a noise model having at least one shape and a gain, dynamically modifying the noise model based on the speech model and the received noisy speech, enhancing the noisy speech at least based on the modified noise model. Hereby is achieved a method of speech enhancement that is able to suppress highly non-stationary noise. Another aspect of the invention relates to a speech enhancement system that may be adapted to be used in a hearing system, such as a hearing aid or a headset.

19 Claims, 14 Drawing Sheets

OTHER PUBLICATIONS

Y. Ephraim, "A Bayesian estimation approach for speech enhancement using hidden Markov models", *IEEE Trans. Signal processing*, vol. 40, No. 4, pp. 725-735, Apr. 1992.

Y. Ephraim, "Gain-adapted hidden Markov models for recognition of clean and noisy speech", *IEEE Trans. Signal Processing*, vol. 40, No. 6, pp. 1303-1316, Jun. 1992.

Y. Zhao, "Frequency-domain maximum likelihood estimation for automatic speech recognition in additive and convolutive noises", *IEEE Trans. Speech and Audio Processing*, vol. 8, No. 3, pp. 255-266, May 2000.

H. Sameti et al., "HMM- based strategies for enhancement of speech signals embedded in nonstationary noise", *IEEE Trans. Speech and Audio Processing*, vol. 6, No. 5, pp. 445-455, Sep. 1998.

Sriam Srinivasan et al., "Codebook-based Bayesian speech enhancement", in *Proc. IEEE Int. Conf. Acoustic, Speech and Signal Processing*, vol. 1, Mar. 2005, pp. 1077-1080.

A. P. Dempster et al. "Maximum likelihood from incomplete data via the EM algorithm", *J. Roy. Statist. Soc. B*, vol. 39, No. 1, pp. 1-38, 1977.

D. M. Titterington, "Recursive parameter estimation using incomplete data", *J. Roy. Statist. Soc. B*, vol. 46, No. 2, pp. 257-267, 1984.

D. A. Barry, P. J. Culligan-Hensley, and S. J. Barry, "Real values of the W-function," ACM Transactions on Mathematical Software, vol. 21, No. 2, pp. 161-171, Jun. 1995.

Bunch, J. R. (1985). "Stability of methods for solving Toeplitz systems of equations." SIAM J. Sci. Stat. Comput., v. 6, pp. 349-364.

V. Krishnamurthy and J. Moore, "On-line estimation of hidden Markov model parameters based on the Kullback-Leibler information measure", *IEEE Trans. Signal Processing*, vol. 41, No. 8, pp. 2557-2573, Aug. 1993.

L. Rabiner, "A tutorial on hidden Markov models and selected applications in speech recognition," Proceedings of the IEEE, vol. 77, No. 2, pp. 257-286, Feb. 1989.

"Methods for subjective determination of transmission quality", ITU-T Recommendation p. 800, Aug. 1996.

H. J. Kushner and G. G. Yin, "*Stochastic Approximation and Recursive Algorithms and Applications*", $2^{nd}$ ed. Springer Verlag, 2003.

S. Boll, "Suppression of acoustic noise in speech using spectral substraction", IEEE Trans. Acoust., Speech, Signal Processing, vol. 2, No. 2, pp. 113-120, Apr. 1979.

* cited by examiner

METHOD AND APPARATUS FOR IMPROVED ESTIMATION OF NON-STATIONARY NOISE FOR SPEECH ENHANCEMENT

CROSS-REFERENCES TO RELATED APPLICATIONS

This application claims the benefit of U.S. Provisional Patent Application Ser. No. 60/713,675, filed Sep. 3, 2005, which is hereby incorporated by reference in its entirety.

FIELD

The present application pertains generally to a method and apparatus, preferably a hearing aid or a headset, for improved estimation of non-stationary noise for speech enhancement.

BACKGROUND

Substantially Real-time enhancement of speech in hearing aids is a challenging task due to e.g. a large diversity and variability in interfering noise, a highly dynamic operating environment, real-time requirements and severely restricted memory, power and MIPS in the hearing instrument. In particular, the performance of traditional single-channel noise suppression techniques under non-stationary noise conditions is unsatisfactory. One issue is the noise estimation problem, which is known to be particularly difficult for non-stationary noises.

Traditional noise estimation techniques are based on recursive averaging of past noisy spectra, using the blocks that are likely to be noise only. The update of the noise estimate is commonly controlled using a voice-activity detector (VAD), see for example TIA/EIA/IS-127, "Enhanced Variable Rate Codec, Speech Service Option 3 for Wideband Spread Spectrum Digital Systems", July 1996.

In the article by I. Cohen, "Noise spectrum estimation in adverse environments: Improved minima controlled recursive averaging", *IEEE Trans. Speech and Audio Processing*, vol. 11, no. 5 pp. 466-475, September 2003, the update of the noise estimate is conducted on the basis of a speech presence probability estimate.

Other authors have addressed the issue of updating the noise estimate with the help of order statistics, e.g. R. Martin, "Noise power spectral density estimation based on optimal smoothing and minimum statistics", *IEEE Trans. Speech and Audio Processing,* vol. 9, no. 5 pp. 504-512, July 2001, and V. Stahl et al., "Quantile based noise estimation for spectral subtraction and Wiener filtering", in *Proc. IEEE Trans. Int. Conf. Acoustics, Speech and Signal Processing*, vol. 3, pp. 1875-1878, June 2000, both of which are hereby incorporated by reference in its entirety.

The methods disclosed in the above mentioned documents are all based on recursive averaging of past noisy spectra, under the assumption of stationary or weakly non-stationary noise. This averaging inherently limits their noise estimation performance in environments with non-stationary noise. For instance, the method of R. Martin referred to above have an inherent delay of 1.5 seconds before the algorithm reacts to a rapid increase of noise energy. This type of delay in various degrees occurs in all above mentioned methods.

In recent speech enhancement systems this problem is addressed by using prior knowledge of speech (e.g. Y. Ephraim, "A Bayesian estimation approach for speech enhancement using hidden Markov models", *IEEE Trans. Signal processing*, vol. 40, no 4, pp. 725-735, April 1992, hereby incorporated by reference in its entirety, and Y. Zhao, "Frequency domain maximum likelihood estimation for automatic speech recognition in additive and convolutive noises", *IEEE Trans. Speech and Audio Processing*, vol. 8, no 3, pp. 255-266", May 2000, which is hereby incorporated by reference in its entirety). While the method of Y. Ephraim does not directly improve the noise estimation performance, the use of prior knowledge of speech was shown to improve the speech enhancement performance for the same noise estimation method. The extension in the method by Y. Zhao referred to above allows for estimation of the noise model using prior knowledge of speech. However, the noise considered in the Y. Zhao method was based on a stationary noise model.

In other recent speech enhancement systems this problem is addressed by using prior knowledge of both speech and noise to improve the performance of speech enhancement systems. See for example e.g. H. Sameti et al., "HMM-based strategies for enhancement of speech signals embedded in nonstationary noise", *IEEE Trans. Speech and Audio Processing*, vol. 6, no 5, pp. 445-455", September 1998, which is hereby incorporated by reference in its entirety).

In the method of H. Sameti et al. noise gain adaptation is performed in speech pauses longer than 100 ms. As the adaptation is only performed in longer speech pauses, the method is not capable of reacting to fast changes in the noise energy during speech activity. A block diagram of a noise adaptation method is disclosed (in FIG. 5 of the reference), said block diagram comprising a number of hidden Markov models (HMMs). The number of HMMs is fixed, and each of them is trained off-line, i.e. trained in an initial training phase, for different noise types. The method can, thus, only successfully cope with noise level variations as well as different noise types as long as the corrupting noise has been modeled during the training process.

A further drawback of this method is that the gain in this document is defined as energy mismatch compensation between the model and the realizations, therefore, no separation of the acoustical properties of noise (e.g., spectral shape) and the noise energy (e.g., loudness of the sound) is made. Since the noise energy is part of the model, and is fixed for each HMM state, relatively large numbers of states are required to improve the modeling of the energy variations. Further, this method can not successfully cope with noise types, which have not been modeled during the training process. . .

In yet another document by Sriam Srinivasan et al., "Codebook-based Bayesian speech enhancement", in *Proc. IEEE Int. Conf Acoustic, Speech and Signal Processing*, vol. 1, March 2005, pp 1077-1080, which hereby is incorporated by reference in its entirety, codebooks are used.

In the codebook-based method, the spectral shapes of speech and noise, represented by linear prediction (LP) coefficients, are modeled in the prior speech and noise models. The noise variance and the speech variance are estimated instantaneously for each signal block, under the assumption of small modeling errors. The method estimates both speech and noise variance that is estimated for each combination of the speech and noise codebook entry. Since a large speech codebook (1024 entries in the paper) is required, this calculation would be a computationally difficult task and requires more processing power that is available in for example a state of the art hearing aid. For good performance of the codebook-based method for known noise environments it requires off-line optimized noise codebooks. For unknown environments, the method relies on a fall-back noise estimation algorithm such as the R. Martin method referred to above. The limitations of the fall-back method would, thus, also apply for the codebook based method in unknown noise environments.

It is known that the overall characteristics of general speech may to a certain extent be learned reasonably well from a (sufficiently rich) database of speech. However, noise can be very non-stationary and may vary to a large extent in real-world situations, since it can represent anything except for the speech that the listener is interested in. It will be very hard to capture all of this variation in an initial learning stage. Thus, while the two last-mentioned methods of speech enhancement perform better than the more traditional, initially mentioned methods, under non-stationary noise conditions, they are based on models trained using recorded signals, where the overall performance of these two methods naturally depends strongly on the accuracy of the models obtained during the training process. These two last-mentioned methods are, thus, apart from being computationally cumbersome, unable to perform a dynamic adaptation to changing noise characteristics, which is necessary for accurate real world speech enhancement performance.

SUMMARY

It is thus an object to provide a method and apparatus, preferably a hearing aid, for improved dynamic estimation of non-stationary noise for speech enhancement.

According to the present application, the above-mentioned and other objects are fulfilled by a method of enhancing speech, wherein the method comprises the steps of receiving noisy speech comprising a clean speech component and a non-stationary noise component, providing a speech model, providing a noise model having at least one shape and a gain, dynamically modifying the noise model based on the speech model and the received noisy speech, and enhancing the noisy speech at least based on the modified noise model.

By providing a speech model and a noise model it is achieved that it is to a certain extent possible to identify those components of the noisy input signal that are due to speech and those that are due to noise, provided that the models are adapted to recognize those said components. The overall characteristics of speech can to a certain extent be learned reasonably well from a sufficiently rich database of speech. However, noise can be very non-stationary and vary to a large extent in real-world situations, partly because it can represent anything except for the speech that the listener is interested in. It will be very hard to capture all of this variation in an initial learning stage, so dynamic (substantially real-time) adaptation to changing noise characteristics will be necessary. Thus, by dynamically modifying the noise model based on the speech model and received noisy speech it is achieved a method that in use will be able to update the noise model to the current noise conditions that may be in the vicinity of a user of the inventive method. Especially, the noise model may be dynamically adapted to accommodate to non-stationary, highly varying noise, which a pre-trained fixed noise model is unlikely to accommodate to, since it will only be able to successfully cope with noise level variations and types of noise that has been modeled during a training process. Thus, by enhancing the noisy speech based on the dynamically modified noise model, a method of speech enhancement is achieved that is capable of coping with quickly changing non stationary noise.

To make such a method for speech enhancement act fast and accurate with limited processing and memory resources, retaining a repository of typical known noise shapes may be very valuable. This repository may in an embodiment of the inventive method have to be adapted to incorporate novel shapes, particular to a certain user and his environments, as well.

Thus in order to make the inventive method work fast with limited resources a preferred embodiment of the inventive method may comprise a noise model having at least one shape and a gain, wherein the at least one shape and gain of the noise model are respectively modified separately, preferably at different rates. By the gain of the noise model it is in one preferred embodiment understood as a variable modeling the energy levels of noise. By a shape it may preferably be understood as a spectrum modeling the relative energy distribution in frequency of the signal (in this case of noise). In a more preferred embodiment of the inventive method a shape may be a gain-normalized energy distribution in frequency. In another embodiment the shape may be a gain normalized distribution in autoregressive coefficients or derivatives thereof, i. e. the shape may be a time domain distribution.

Since the energy levels of noise in noisy speech may change rapidly and significantly quicker than the nature of the noise that is present in a noisy speech signal a preferred embodiment of the inventive method may comprise a step, wherein the gain of the noise model may be dynamically modified at a higher rate than the shape of the noise model.

In a further preferred embodiment of the inventive method, the noisy speech enhancement may further be based on the speech model. By basing the speech enhancement on a speech model a better estimate of what is speech and what is noise in the noisy speech is achieved, whereby a better speech enhancement is achieved. A further advantage is a faster adaptation, because the prior knowledge about speech that is provided by the speech model leads to a better starting point for the speech enhancement method according to the inventive method.

The inventive method may in a further embodiment comprise a step of dynamically modifying the speech model based on the noise model and the received noisy speech. Hereby is achieved a speech enhancement system that does not require a database of speech that is sufficiently rich as to cope with most speech situations, whereby memory and processing power is saved. Therefore it is advantageous (from a practical computational and memory point of view) to use a speech model that is adapted to model the most common characteristics of speech and in using the inventive method adapt the speech model to incorporate the current (real-time) characteristics of the clean speech component or components in the received noisy speech.

It is understood that by the term real-time is meant within a certain more closely specified, suitably chosen, time span, or a certain more closely specified, suitably chosen, number or signal blocks. This time span or number of signal blocks, may be chosen in dependence of where and under what circumstances the inventive method is applied, furthermore, it may even be chosen in dependence of the specific algorithms used. Examples of said time span may be a time span chosen from the interval 1 ns (nanosecond)-100 milliseconds, preferably 1 microsecond-100 milliseconds, even more preferably 1 milliseconds-100 microseconds, yet even more preferably 1 milliseconds-50 milliseconds. Examples of said number of signal blocks may be any number in the interval from 1 block-100 blocks, preferably 1 block-20 blocks, wherein each block comprises a number of samples, possibly ranging from 1-1000 samples. Consecutive blocks may even have one, two or more samples in common. It is also understood that in a preferred embodiment the dynamical modification of the speech and/or noise model is performed continuously, i.e. for example on consecutive blocks or samples.

Since the dynamically modified speech model, in use, better models the current speech the noisy speech enhancement may advantageously further be based on the modified speech model, whereby better speech enhancement is achieved.

One embodiment of the inventive method may furthermore comprise the step of estimating the noise component based on the modified noise model, wherein the noisy speech is enhanced based on the estimated noise component. By using the modified noise model to estimate the noise component the prior knowledge of noise that is embedded in the noise model may be utilized to obtain a faster and more accurate estimate of the noise component of the noisy speech. This will in turn give a better and faster speech enhancement of the noisy speech.

The dynamic modification of the noise model, the noise component estimation, and the noisy speech enhancement may in a preferred embodiment of the inventive method be repeatedly performed. Hereby is achieved a method wherein the noise model, noise component estimation and speech enhancement is continually adapted to cope with the current listening conditions where the inventive method may be used.

The inventive method may in a further embodiment comprise a step of estimating the speech component based on the speech model, wherein the noisy speech is enhanced based on the estimated speech component. By using the speech model to estimate the speech component the prior knowledge of speech that is embedded in the speech model may be utilized to obtain a faster and more accurate estimate of the speech component of the noisy speech. This will in turn give a better and faster speech enhancement of the noisy speech, since a better separation of noise and speech components in the noisy speech is achieved.

Due to the stochastic nature of background noise in speech, the separation of speech from noise may be based on probabilistic models (also referred to as statistical models). Thus in a preferred embodiment the noise model may be a probabilistic model, such as a Gaussian process, Poisson process, or even more preferably a hidden Markov model (HMM). By using a HMM it is, furthermore, possible to model both the distribution and temporal (ordering) features of an entity, such as for example noise. Moreover, it is achieved that a noise signal may be well characterized as a parametric random process, and the parameters of the stochastic process can be determined, or estimated in a well-defined manner. Due to the stochastic nature of noise, i.e. noise can vary stochastically in energy level as well as in the type of noises. The states in the HMM may be characterized as one typical noisy sound. In a preferred embodiment there may be provided an HMM for each of a number of different types of noise, e.g. babble noise, traffic noise, music noise or wind noise, and within each of these HMM's there are a number of states that model some typical sounds within each of the different types of noise. Within each of the different types of noise it should preferably be allowed to jump between any of the number of sounds in order to allow for a model that is able to model more complex sounds within said individual noise types. Therefore, the noise model is in a preferred embodiment an ergodic HMM, i.e. state transitions between all the states within the individual HMM's are allowed.

The speech model may in a further preferred embodiment of the inventive method be a hidden Markov model (HMM). This is due to the fact that speech may also be understood as a stochastic process, and may thus be modeled very well using HMM's. However, there is usually more structure in a speech signal than in a noise signal. Thus the HMM's will be different for speech than those for noise. This structure may for example emerge from the unvoiced periods in most typical speech signals or e.g. the harmonicity of speech. Since, we for the purpose of speech enhancement are not interested in recognizing the specific words in a speech signal, but only the underlying structure of speech, the states of a HMM that is used to model speech may in a preferred embodiment comprise some sounds that are typical for speech. In order to be able to model more complex speech sounds, transitions between all the states of the model are preferably allowed. Thus, the speech model may in a preferred embodiment be an ergodic HMM.

The speech and noise gains may, thus, in a preferred embodiment of the used models be incorporated in a HMM framework, where the speech and noise gains maybe defined as stochastic variables modeling the energy levels of speech and noise, respectively. The separation of speech and noise gains may facilitate incorporation of prior knowledge of these entities, which may be beneficial for estimation accuracy (of e.g. the speech and noise gains). In one embodiment the speech gain may be assumed to have distributions that depend on the states of the HMM. Such an embodiment of the speech model will thus facilitate the reasonable assumption that a voiced sound typically has a larger gain than an unvoiced sound under most real life situations. The dependency of gain and spectral shape may then be implicitly modeled, since they are tied to the same state.

Speech and noise may comprise some time-invariant parameters. Thus, in one embodiment, the time invariant parts of the speech and noise models may initially be trained using training data (in the scientific literature on this subject this is often referred to as off-line training), together with the remainder of the HMM parameters. The time-varying part may thus according to the inventive method be estimated (dynamically) using the observed noisy speech, i.e. during substantially real-time use of the inventive method. This way a method of noisy speech enhancement is achieved which will adapt quicker to a current listening or environment situation. Further advantages are that by training the time invariant parts of the speech and/or noise model(s) are that the computational problem at hand may be reduced significantly, and if the same computational level is maintained as when not using this knowledge of the time invariant parts a higher degree of accuracy is achieved.

In one embodiment of the inventive method may the noise model HMM or the speech model HMM be a Gaussian mixture model. In an Alternative embodiment may both the speech model HMM and the noise model HMM be Gaussian mixture models. By using a mixture model it is achieved a model in which the variables are considered to be randomly drawn from one mixture component. A further advantage of using a mixture model is that a mixture model may be used to model a probability function as a sum of parameterized functions. Thus, by using a Gaussian Mixture model the computational problem is reduced. This reduction in computational complexity emerges also partly from the fact that in a Gaussian Mixture model the state transitions are left out of the computations.

The noise model may in one embodiment be derived from a repository or at least one code book. Hereby is achieved faster convergence, computational efficiency and a means whereby local minima may be avoided. Off-line (initial) training of a set of models in a codebook may allow for the use of more elaborate prior models, which is especially important in those cases, wherein only limited processing and memory is available, as is the case in for example a standard hearing aid known in the art.

The provision of a noise model may in one embodiment comprise the selection of one of a plurality of noise models based on the non-stationary noise component in the noisy speech signal. Hereby is achieved a way of providing a noise model that models the substantially instantaneous noise in a good manner. In a preferred embodiment the noise gain may be separated from the shapes and, preferably, shared between the plurality of noise models. The separation of noise gain and shape is consistent with the reality, since the change of the noise energy, e.g., due to movement of the noise source or recording device, is typically independent from the acoustic sounds from the noise source.

The provision of a noise model may in an alternative embodiment comprise a step of selecting one of a plurality of noise models based an environment classifier output. By basing the selection of a noise model on an environment classifier output it is possible to select a noise model that best models the nature of the ambient noise, for example babble noise, traffic noise, music noise or wind noise. A further advantage of basing the selection of a noise model on an environment classifier output is that the shape of the noise, which typically is depending on the nature of the noise in the environment, may be modeled quickly and without much use of lengthy calculations. An even further advantage of using a classifier output is that it allows for a determination of whether there is a noise model in the list that models the ambient noise sufficiently good. Because if this is not the case then the classifier output may be used to decide whether it would be a better solution to adapt the currently used noise model to the actual noisy environment, whereby a possible temporary degradation (by choosing a noise model that does not models the noise so good) of the speech enhancement is avoided.

A further object is achieved by a method of enhancing speech, wherein the method comprises the steps of receiving noisy speech comprising a clean speech component and a noise component, providing a cost function equal to a function of a difference between an candidate for an estimated enhanced speech component and a function of the clean speech component and the noise component, enhancing the noisy speech based on estimated speech and noise components, and minimizing the Bayes risk for said cost function to obtain the enhanced speech component.

By providing a cost function that may be equal to a function of a difference between a candidate for an estimated enhanced speech component and a function of the clean speech component and the noise component and by minimizing the Bayes risk for the cost function, it is achieved a Bayesian estimator that allows for an adjustable level of residual noise. By explicitly leaving some level of residual noise, the criterion reduces the processing artifacts, which are commonly associated with traditional speech enhancement systems.

The enhancement of the noisy speech may, preferably further be based on a speech model and a noise model. Hereby is achieved a method of speech enhancement, wherein a better separation of the noisy speech into noise and speech. This ultimately leads to better speech enhancement.

In a further embodiment may the cost function further be a function of the noise component, e.g., shaping of the noise component based on the masking properties of the speech component. Hereby is achieved a way in which the noise floor may be adjusted in order to accommodate to different noise types.

The cost function may in a preferred embodiment be the squared error function for estimated speech compared to clean speech plus a function of the residual noise. By explicitly leaving some level of residual noise in the cost function, the minimization of the Bayes risk for the cost function will reduce the processing artifacts, which are commonly associated with traditional prior art speech enhancement systems. For example unlike a constrained optimization approach, which is limited to linear estimators, the proposed Bayesian estimator is nonlinear as well. A further advantage of this choice of cost function is that the residual noise level may be extended to be time and frequency dependent, in order to incorporate the perceptual shaping of the noise.

Some types of noise may be more irritating or even more dangerous than other types of noise. Thus, there is a need for a method, wherein it is possible to tune the level of the residual noise component. Hence, in one embodiment of the inventive method the function of the residual noise component may be the function of multiplying the residual noise component by an epsilon parameter, which epsilon parameter furthermore is chosen in dependence of the received noisy signal. Hereby is achieved that the signal pressure level of the residual noise component may explicitly be tuned on the basis of the received noisy signal, and thereby in dependence of the type of the received noisy signal.

The perception of speech in noise is usually individual and may depend on the type of noise wherein the speech is perceived. For example speech in babble noise may cause that one individual finds it very hard to understand the spoken speech, while another individual will have great difficulties of understanding speech in traffic noise. Hence, in an alternative embodiment the epsilon parameter may be chosen in dependence of a human perception of the noisy signal or some average of human perception of the noisy signal averaged over a certain number of humans having the same type of perceptual hearing loss. Preferably the choice of the epsilon parameter may be individually chosen and adapted to the needs of a particular individual. Thus a high degree of customization of the inventive method may be achieved Some traditional speech enhancement systems use a fixed list of noise models. e.g. a list of HMMs that may be trained for different noise types. The noise model in the list that is most likely to generate the noise that is present in a noisy environment is then used in the speech enhancement. However, such a system can not cope with noise, which it has not initially been trained for. Such a speech enhancement system will thus only be able to successfully cope with a limited number of noisy situations. However, due to the wide variety of noisy situations that may occur in real-life situations there is a need for a method of maintaining a plurality (also referred to as a list or repository throughout the present specification) of noise models.

Thus, an even further object is achieved by a method of maintaining a list of noise models, where the method comprises the steps of receiving noisy speech, dynamically modifying one of the noise models based on the received noisy speech, comparing the modified noise model to the list of noise models, and adding the modified noise model to the noise model list based on the comparison.

Alternatively, a further embodiment of the method of speech enhancement may further comprise the steps of comparing the dynamically modified noise model to the plurality of noise models, and adding the modified noise model to the plurality of noise models based on the comparison.

Hereby is achieved a method, wherein the list (or plurality) of noise models that may be used in for example, but generally not limited to, a speech enhancement system, will be in compliance with the actual noise situations wherein the method is applied, because at least one of the models in the list is dynamically modified in dependence of the received noisy speech. In order to avoid an endless expansion of the list of noise models, the modified model may be compared with the models that already are in the list, and add the dynamically modified model to the list on the basis of this comparison. A further advantage of such a system is that the list of noise models will gradually be adapted to those noisy environments, wherein the method is applied. A great deal of customization or individualization is thus achieved with such an inventive method of maintaining a list of noise models. For example if such a method of maintaining a list of noise models is used in conjunction with a method of speech enhancement, then the speech enhancement will adapt faster to those particular noisy environments, wherein the user of the inventive method is most likely to be in or visit, because the list of noise models will gradually individualize to the needs of said user. On the other hand the inventive method of maintaining a list of noise models makes adjustments to new noisy situations possible, since those new noisy situations may be accounted for by an addition of an appropriately modified noise model to the list.

In a preferred embodiment the inventive method of maintaining a list of noise model is adapted to be used in a method of speech enhancement according to the description above.

In an alternative embodiment of the inventive method of maintaining a list of noise models the method may even comprise the possibility of letting a user of the method intervene whether a noise model should be added to the list or not. This may for example be of importance if the user is in a noisy environment, which is of lesser importance for his or her understanding or perception of speech. The user may also be given the opportunity to switch of the addition of a noise model to the list. This may for example be of importance in those circumstances, wherein the user is positioned in a noisy sound environment that he or she rarely experiences. This way it is avoided that noise models, which are unlikely to be used are added to the list. Thus, memory storage is saved.

In a preferred embodiment the modified noise model may be added to the noise model list if a difference between the modified noise model and at least one of the noise models in the list is greater than a threshold (or alternatively in one embodiment of the speech enhancement system the modified noise model may be added to the plurality of noise models if a difference between the modified noise model and at least one of the plurality of noise models is greater than a threshold).

Hereby is achieved that minor and/or subtle differences in the noisy environments will not imply an addition to the list of noise models by a modified noise model. By a suitable choice of a threshold the maintaining of the list of noise models may be controlled in such a manner that only when certain benefit in for example adaptation speed is achieved, the list of models is updated. In one other embodiment the threshold may furthermore comprise an evaluation of how often a certain number or types of modifications occur, preferably within a certain time-span. A further advantage of using a threshold is that additions to the list of noise models are preferably performed when an update of the list of noise models is beneficial, for example with respect to adaptation speed or quality, to the particular user of the method.

An alternative embodiment of the inventive method of maintaining a list of noise models may further comprise the step of deleting a model from the list if it has not been used for a certain suitable period of time. Whereby it is achieved that the list of noise models is kept at a level where a balance between the benefit of having a high number of models in the list and keeping the processing power and memory usage as low as possible.

For the same reasons as mentioned before the noise may be based on probabilistic models (also referred to as statistical models). Thus in a preferred embodiment of the inventive method of maintaining a list of noise models, said noise models may be probabilistic models, for example such models that may be described as a Gaussian process, Poisson process, or even more preferably a hidden Markov models (HMMs). Hereby is achieved that noise signal may be well characterized as a parametric random process, and the parameters of the stochastic process can be determined, or estimated in a well-defined manner. And for the same reasons as mentioned before the noise models may be ergodic HMM's. Fore the same reasons as mentioned earlier may the noise models be Gaussian mixture models. A further advantage of using Gaussian mixture models in the inventive method of maintaining a list of noise models is that they are easily comparable. Thus, by using Gaussian mixture models it is achieved an easy way of comparing a modified model with the models in the list and thus determining whether it will be beneficial to add the modified model to the list.

For the same reasons as mentioned before it may be beneficial to initially derive the noise models from a code book. Thus, in an embodiment of the inventive method the noise models may initially be derived from at least one code book. A further advantage this embodiment is that it provides a simple way of maintaining and/or even extending a code book.

A further object is achieved by a speech enhancement system comprising, a speech model, a noise model having at least one shape and a gain, a microphone for the provision of an input signal based on the reception of noisy speech, which noisy speech comprises a clean speech component and a non-stationary noise component, a signal processor adapted to modify the noise model based on the speech model and the input signal, and enhancing the noisy speech on the basis of the modified noise model in order to provide a speech enhanced output signal, wherein the signal processor may further be adapted to perform the modification of the noise model dynamically. The signal processor may further be adapted to perform a method according to any of the steps described above.

A yet even further object may be achieved by a speech enhancement system comprising, a microphone for the provision of an input signal based on the reception of noisy speech, which noisy speech comprises a clean speech component and a non-stationary noise component, a signal processor adapted to process the input signal in order to provide a speech enhanced output signal based on estimated speech and noise components, by minimizing the Bayes risk for a cost function in order to obtain the enhanced speech component, wherein the cost function is equal to a function of a difference between an enhanced speech component and a function of the clean speech component and the noise component. The signal processor may further be adapted to perform a method according to any of the steps described above.

An even further object is achieved by speech enhancement system as described above that is further being adapted to be used in a hearing system.

In a preferred embodiment the hearing system may comprise a hearing aid, which hearing aid may comprise: A microphone for the provision of an input signal, a signal processor for processing of the input signal into an output signal, including (preferably frequency dependent) amplification of the input signal for compensation of a hearing loss of a wearer of the hearing aid, and a receiver for the conversion of the output signal into an output sound signal to be presented to the user of said hearing aid, wherein the signal processor is adapted to execute any of the steps, or any combination of the steps, of the inventive method described above.

Alternatively the hearing system may comprise a prior art hearing aid, that is modified to be adapted to perform any of the steps according to the inventive method.

It is understood that the hearing aid may be a behind-the-ear (BTE), in-the-ear (ITE), completely-in-the-channel (CIC), receiver-in-the-ear (RIE) or cochlear implant or otherwise mounted hearing aid.

In one embodiment the hearing system may further comprise a portable personal device that may be operatively connected to the hearing aid by for example a wireless or wired link, wherein the portable personal device comprises a processor that is adapted to execute a method of maintaining a list of noise models (also referred to as dictionary extension), and wherein the hearing aid signal processor that forms part of the hearing system is adapted to execute a method of speech enhancement according to any of the steps explained above. The wired or wireless link between the hearing aid and the portable personal device is preferably bidirectional, so that microphone input from the hearing aid may be used to maintain the list (plurality) of noise models in the portable personal device, and the updated list (plurality) of noise models in the portable personal device may be used in a method of speech enhancement in the hearing aid. Hereby is achieved that processing power and memory required for the maintaining of the list of noise models is moved away from the hearing aid, which usually has very limited processing power and memory capabilities.

The portable personal device is preferably of such a size and weight that it may easily be adapted to be body worn. In a preferred embodiment the portable personal device may be any one of the following: A mobile phone, a PDA, a special purpose portable computing device. The link between the portable personal device and the hearing aid may for example be provided by an electrical wire or some suitable chosen wireless technology, such as Blue Tooth, Noah Link or some other special purpose wireless technology.

In an alternative embodiment the hearing system may comprise a headset. Here it is understood that a headset may comprise an earphone and a transmitter, both of which are adapted to be mounted at a head of a user. In the patent literature and other technical or popular literature a headset is sometimes referred to as a pair of headphones that are adapted to be worn at the head of a user. Alternatively a headset may simply be referred to as a device similar in functionality to that of a regular telephone handset but is worn on the head to keep the hands free. Alternatively a headset is simply referred to as a headphone, earphone, earpiece, earset or earbud.

The hearing system may in a preferred embodiment comprise a headset and a mobile phone, wherein the shape adaptation of the noise models according to the inventive method is performed in the mobile phone and the gain adaptation according to the inventive method is performed in the headset.

The signal processor of the speech enhancement system may in an embodiment further be adapted to modify the at least one shape and gain of the noise model separately.

The signal processor of the speech enhancement system may in an embodiment further be adapted to modify the gain of the noise model at a higher rate than the shape of the noise model.

The signal processor of the speech enhancement system may in an embodiment further be adapted to perform the noisy speech enhancement on the basis of the speech model.

The signal processor of the speech enhancement system may in an embodiment further be adapted to dynamically modifying the speech model based on the noise model and the input signal.

The signal processor of the speech enhancement system may further be adapted to perform the noisy speech enhancement on the basis of the dynamically modified speech model.

The signal processor of the speech enhancement system may in an embodiment further be adapted to estimate the noise component based on the modified noise model and enhance the noisy speech on the basis of the estimated noise component.

The signal processor of the speech enhancement system may in an embodiment further be adapted to perform the dynamical modification of the noise model, the estimation of the noise component and the speech enhancement, repeatedly.

The signal processor of the speech enhancement system may in an embodiment further be adapted to estimate the speech component based on the speech model and enhance the noisy speech on the basis of the estimated speech component.

According to a preferred embodiment of the speech enhancement system the noise model may be a hidden Markov model (HMM).

According to a preferred embodiment of the speech enhancement system the speech model may be a hidden Markov model (HMM).

The HMM may according to a preferred embodiment of the speech enhancement system be a Gaussian mixture model.

The signal processor of the speech enhancement system may in an embodiment further be adapted to derive the noise model from at least one code book.

The signal processor of the speech enhancement system may in an embodiment further be adapted to select one of a plurality of noise models in dependence of the non-stationary noise component of the noisy speech signal.

One embodiment of the speech enhancement system may further comprise an environment classifier that is operatively connected to the signal processor, said signal processor further being adapted to select one of a plurality of noise models in dependence of the output of said classifier.

According to a preferred embodiment of the speech enhancement system, the cost function may further be a function of a residual noise component.

According to another embodiment of the speech enhancement system the cost function may be a squared error function for estimated speech compared to clean speech plus a function of the residual noise.

According to another embodiment of the speech enhancement system the function of the residual noise component is multiplying the residual noise component by an epsilon parameter chosen in dependence of the received noisy signal.

The signal processor of the speech enhancement system may further be adapted to select the epsilon parameter in dependence of a human perception of the noisy signal or some average of human perception of the noisy signal averaged over a certain number of humans.

A further understanding of the nature and advantages of the present embodiments may be realized by reference to the remaining portions of the specification and the drawings.

BRIEF DESCRIPTION OF THE DRAWINGS

In the following, preferred embodiments are explained in more detail with reference to the drawings, wherein.

DETAILED DESCRIPTION OF THE EMBODIMENTS

Figure 1:
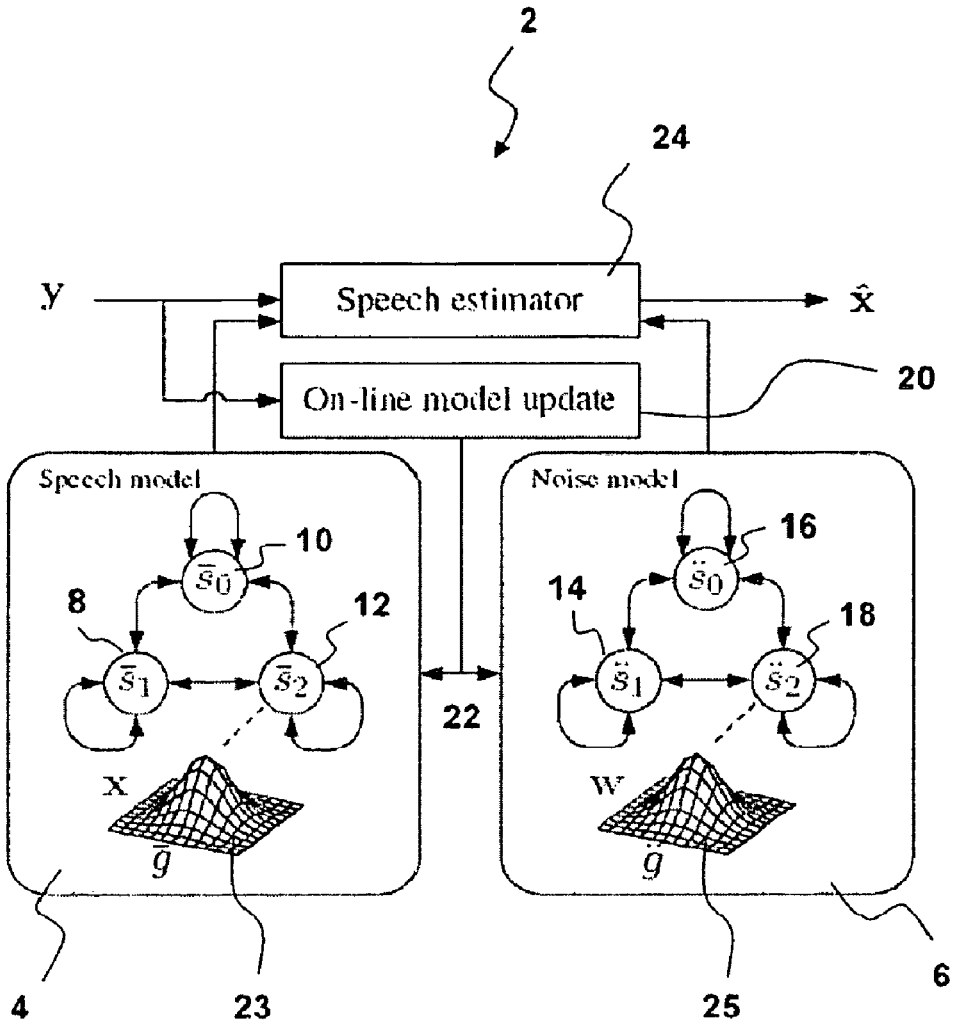
FIG. 1 shows a schematic diagram of a speech enhancement system according one embodiment.

The present embodiments will now be described more fully hereinafter with reference to the accompanying drawings, in which exemplary embodiments are shown. The embodiments may, however, be embodied in different forms and should not be construed as limited to the embodiments set forth herein. Rather, these embodiments are provided so that this disclosure will be thorough and complete, and will fully convey the scope of the application to those skilled in the art. Like reference numerals refer to like elements throughout.

In FIG. 1 is shown a schematic diagram of a speech enhancement system 2 that is adapted to execute any of the steps of the inventive method. The speech enhancement system 2 comprises a speech model 4 and a noise model 6. However, it should be understood that in another embodiment the speech enhancement system 2 may comprise more than one speech model and more than one noise model, but for the sake of simplicity and clarity and in order to give as concise an explanation of the preferred embodiment as possible only one speech model 4 and one noise model 6 are shown in FIG. 1. The speech and noise models 4 and 6 are preferably hidden Markov models (HMMs). The states of the HMMs are designated by the letter s and g denotes a gain variable. The overbar is used for the variables in the speech model 4, and double dots are used for the variables in the noise model 6. For simplicity only three states 8, 10, 12, 14, 16 and 18 are shown in each of the models 4 or 6. The double arrows between the states 8, 10, and 12 in the speech model 4, correspond to possible state transitions within the speech model 4. Similarly, the double arrows between the states 14, 16, and 18 in the noise model, correspond to possible state transitions within the noise model 6. With each of said arrows there is associated a transition probability. Since it is possible to go from one state 8, 10 or 12 in the noise model 4 to any other state (or the state itself) 8, 10, 12 of the noise model 4, it is seen that the noise model 4 is ergodic. However, it should be appreciated that in another embodiment certain suitable constraints may be imposed on what transitions are allowable.

In FIG. 1 is furthermore shown the model updating block 20, which upon reception of noise speech Y updates the speech model 4 and/or the noise model 6. The speech model 4 and/or the noise model 6 are thus modified on the basis on the received noisy speech Y. The noisy speech has a clean speech component X and a noise component W, which noise component W may be non-stationary. In the preferred embodiment shown in FIG. 1 both the speech model 4 and the noise model 6 are updated on the basis on the received noisy speech Y, as indicated by the double arrow 22. However, the double arrow 22 also indicates that the updating of the noise model 6 is based on the speech model 4 (and the received noisy speech Y), and that the updating of the speech model 4 is based on the noise model 6 (and the received noisy speech Y). The speech enhancement system 2 also comprises a speech estimator 24. In the speech estimator 24 an estimation of the clean speech component X is provided. This estimated clean speech component is denoted with a "hat", i.e. $\hat{X}$. The output of the speech estimator 24 is the estimated clean speech, i.e. the speech estimator 24 effectively performs an enhancement of the noisy speech. This speech enhancement is performed on the basis on the received noisy speech Y and the modified noise model 6 (which has been modified on the basis on the received noisy speech Y and the speech model). The modification of the noise model 6 is preferably done dynamically, i.e. the modification of the noise model is for example not confined to (longer) speech pauses. In order to obtain a better estimation of the clean speech and thereby obtain better speech enhancement, the speech estimation in the speech estimator 24 is furthermore based on the speech model 4. Since, the speech enhancement system 2 performs a dynamic modification of the noise model 6, the system is adapted to cope very well with non-stationary noise. It is furthermore understood that the system may furthermore be adapted to perform a dynamic modification of the speech model as well. However, while it is possible that the nature and level of speech may wary, it is understood that often the speech model 4 does not need to be updated as often as the noise model 6. Therefore, the updating of the speech model 4 may preferably run on a slower rate than the updating of the noise model 6, and in an alternative embodiment the speech model 4 may be constant, i.e. it may be provided as a generic model, which initially may be trained off-line. Preferably such a generic speech model 4 may trained and provided for different regions (the dynamically modified speech model 4 may also initially be trained for different regions) and thus better adapted to accommodate to the region where the speech enhancement system 2 is to be used. For example one speech model may be provided for each language group, such as one fore the Slavic languages, Germanic languages, Latin languages, Anglican languages, Asian languages etc. It should, however, be understood that the individual language groups could be subdivided into smaller groups, which groups may even consist of a single language or a collection of (preferably similar) languages spoken in a specific region and one speech model may be provided for each one of them.

Associated with the state 12 of the speech model 4 is shown a plot 23 of the speech gain variable. The plot 23 has the form of a Gaussian distribution. This has been done in order to emphasize that the individual states 8, 10 or 12 of the speech model 4 may be modeled as stochastic variables that have the form of a distribution in general, and preferably a Gaussian distribution. In one preferred embodiment a speech model 4 may then comprise a number of individual states 8, 10, and 12, wherein the variables are Gaussians that for example model some typical speech sound, then the full speech model 4 may be formed as a mixture of Gaussians in order to model more complicated sounds. It is, however, understood that in an alternative embodiment each individual state 8, 10, and 12 of the speech model 4 may be a mixture of Gaussians. In a further alternative embodiment the stochastic variable may be given by point distributions, e.g. as scalars.

Similarly, associated with the state 18 of the noise model 6 is shown a plot 25 of the noise gain variable. The plot 25 has also the form of a Gaussian distribution. This has been done in order to emphasize that the individual states 14, 16 or 18 of the noise model 6 may be modeled as stochastic variables that have the form of a distribution in general, and preferably a Gaussian distribution in particular. In one preferred embodiment a noise model 6 may then comprise a number of individual states 14, 16, and 18 wherein the variables are Gaussians that for example model some typical noise sound, then the full noise model 6 may be formed as a mixture of Gaussians in order to model more complicated noise sounds. It is, however, understood that in an alternative embodiment each individual state 14, 16, and 18 of the noise model 6 may be a mixture of Gaussians. In a further alternative embodiment the stochastic variable may be given by point distributions, e.g. as scalars.

In the following a more detailed description of two algorithmic implementation of the operation of the speech enhancement system 2 according to a preferred embodiment of the inventive method is given. In the first implementation parameterization by AR coefficients is used and in the second implementation parameterization by spectral coefficients is used. Which one of the two implementations will be preferred in a practical situation will typically depend on the system (e.g. memory and processing power) wherein the speech enhancement system is used.

Parameterization by AR—Coefficients

Accurate modeling and estimation of speech and noise gains facilitate good performance of speech enhancement methods using data-driven prior models. A hidden Markov model (HMM) based speech enhancement method using explicit gain modeling is used. Through the introduction of stochastic gain variables, energy variation in both speech and noise is explicitly modeled in a unified framework. The speech gain models the energy variations of the speech phones, typically due to differences in pronunciation and/or different vocalizations of individual speakers. The noise gain helps to improve the tracking of the time-varying energy of non-stationary noise. An expectation-maximization (EM) algorithm is used to perform off-line estimation of the time-invariant model parameters. The time-varying model parameters are estimated on a substantially real-time basis (by substantially real-time it is in one embodiment understood that the estimation may be carried over some samples or blocks of samples, but is done continuously, i.e. the estimation is not confined to for example longer speech pauses) using a recursive EM algorithm. The proposed gain modeling techniques are applied to a novel Bayesian speech estimator, and the performance of the proposed enhancement method is evaluated through objective and subjective tests. The experimental results confirm the advantage of explicit gain modeling, particularly for non-stationary noise sources.

In this particular embodiment a unified solution to the aforementioned problems is proposed using an explicit parameterization and modeling of speech and noise gains that is incorporated in the HMM framework. The speech and noise gains are defined as stochastic variables modeling the energy levels of speech and noise, respectively. The separation of speech and noise gains facilitates incorporation of prior knowledge of these entities. For instance, the speech gain may be assumed to have distributions that depend on the HMM states. Thus, the model facilitates that a voiced sound typically has a larger gain than an unvoiced sound. The dependency of gain and spectral shape (for example parameterized in the autoregressive (AR) coefficients) may then be implicitly modeled, as they are tied to the same state.

Time-invariant parameters of the speech and noise gain models are preferably obtained off-line using training data, together with the remainder of the HMM parameters. The time-varying parameters are estimated in a substantially real-time fashion (dynamically) using the observed noisy speech signal. That is, the parameters are updated recursively for each observed block of the noisy speech signal. Solutions to parameter estimation problems known in the state of the art, are based on a regular and recursive expectation maximization (EM). framework described in A. P. Dempster et. al. "Maximum likelihood from incomplete data via the EM algorithm", *J. Roy. Statist. Soc. B,* vol. 39, no. 1, pp. 1-38, 1977, which hereby is incorporated by reference in its entirety, and D. M. Titterington, "Recursive parameter estimation using incomplete data", *J. Roy. Statist. Soc. B*, vol. 46, no. 2, pp. 257-267, 1984, Which hereby is incorporated by reference in its entirety. The proposed HMMs with explicit gain models are applied to a novel Bayesian speech estimator, and the basic system structure is shown in FIG. 1. The proposed speech HMM is a generalized AR HMM (a description of AR HMMs is for example described in Y. Ephraim, "A Bayesian estimation approach for speech enhancement using hidden Markov models", *IEEE Trans. Signal Processing*, vol. 40, no 4, pp. 725-735, April 1992, where the signal is modeled as an AR process for a given state, and the states are connected through transition probabilities of a Markov chain), where the speech gain is implicitly modeled as a constant of the state-dependent AR models. Thus, the variation of the speech gain within a state is not considered.

It has been proposed in the prior art that the speech gain may be estimated dynamically using the observation of noisy speech and optimizing a maximum likelihood (ML) criterion. Whereby, the method implicitly assumes a uniform prior of the gain in a Bayesian framework. The subjective quality of the gain-adaptive HMM method has, however, been shown to be inferior to the AR-HMM method, partly due to the uniform gain modeling. In the present patent application, stronger prior gain knowledge is introduced to the HMM framework using state-dependent gain distributions.

According to the present embodiments a new HMM based gain-modeling technique is used to improve the modeling of the non-stationarity of speech and noise. An off-line training algorithm is proposed based on an EM technique. For time-varying parameters, a dynamic estimation algorithm is proposed based on a recursive EM technique. Moreover, the superior performance of the explicit gain modeling is demonstrated in the speech enhancement, where the proposed speech and noise models are applied to a novel Bayesian speech estimator.

The Signal Model

We consider the estimation of the clean speech signal from speech contaminated by independent additive noise. The signal is processed in blocks of K samples, within which we can assume the stationarity of the speech and noise. The n'th noisy speech signal block is modeled as (Eq. 1):

$$Y_n = X_n + W_n \quad \text{a.}$$

where $Y_n=[Y_n[0], \ldots, Y_n[K-1]]^T$, $X_n=[X_n[0], \ldots, X_n[K-1]]^T$ and $W_n=[W_n[0], \ldots, W_n[K-1]]^T$ are random vectors of the noisy speech signal, clean speech and noise, respectively. Uppercase letters are used to represent random variables, and lowercase letters to represent realizations of these variables.

The statistical modeling of speech X and noise W with explicit speech and noise gain models is discussed in section 1A and 1B. The modeling of the noisy speech signal Y is discussed in section 1C.

1A. Speech Model

The statistics of the speech is described by using an HMM with state-dependent gain models. Overbar is used to denote the parameters of the speech HMM. Let (Eq. 2):

$$x_0^{N-1} = \{x_0, \ldots, x_{N-1}\}|$$

denote the sequence of the speech block realizations from 0 to N−1, the probability density function (PDF) of $x_0^{N-1}$ is then modeled as (Eq. 3):

$$f(x_0^{N-1}) = \sum_{\bar{s} \in \bar{S}} \prod_{n=0}^{N-1} \bar{a}_{\bar{s}_{n-1}\bar{s}_n} f_{\bar{s}_n}(x_n) \Bigg|$$

The summation is over the set of all possible state sequences $\bar{S}$ and for each realization of the state sequence $\bar{s}=[\bar{s}_0, s_1, \ldots, \bar{s}_{N-1}]$, where $\bar{s}_n$ denotes the state of the n'th block. $\alpha_{\bar{s}_{n-1}\bar{s}_n}$ denotes the transition probability from state $\bar{s}_{n-1}$ to state $\bar{s}_n$. The probability density function of $x_n$ for a given state s is the integral over all possible speech gains (For clarity of the derivations we only assume one component pr. state. The extension to mixture models (e.g. Gaussian Mixture models) is straight forward by considering the mixture components as sub-states of the HMM). Modeling the speech gain in the logarithmic domain, we then have (Eq. 4):

$$f_{\bar{s}}(x_n) = \int_{-\infty}^{\infty} f_{\bar{s}}(\bar{g}'_n) f_{\bar{s}}(x_n|\bar{g}'_n) d\bar{g}'_n \Bigg|$$

where (Eq. 5a):

$$\bar{g}'_n = \log \bar{g}_n |$$

denotes the speech gain in the linear domain. The integral is formulated in the logarithmic domain for the convenient modeling of the non-negative gain. Since the mapping between $\bar{g}_n$ and $\bar{g}'_n$ is one-to-one, we use an appropriate notation based on the context below.

The extension over the traditional AR-HMM is the stochastic modeling of the speech gain $\bar{g}_n$, where $\bar{g}_n$ is considered as a stochastic process. The PDF of $\bar{g}_n$ is modeled using a state-dependent log-normal distribution, motivated by the simplicity of the Gaussian PDF and the appropriateness of the. logarithmic scale for sound pressure level. In the logarithmic domain, we have (Eq. 5b):

$$f_{\bar{s}}(\bar{g}'_n) = \frac{1}{\sqrt{2\pi\bar{\psi}_{\bar{s}}^2}} \exp\left(-\frac{1}{2\bar{\psi}_{\bar{s}}^2}(\bar{g}'_n - \bar{\phi}'_{\bar{s}} - \bar{q}_n)^2\right)$$

with mean $\bar{\phi}_{\bar{s}}+\bar{q}_n$ and variance $\bar{\psi}_{\bar{s}}^2$. The time-varying parameter $\bar{q}_n$ denotes the speech-gain bias, which is a global parameter compensating for the overall energy level of an utterance, e.g., due to a change of physical location of the recording device. The parameters $\{\bar{\phi}_{\bar{s}}, \bar{\psi}_{\bar{s}}^2\}$ are modeled to be time-invariant, and can be obtained off-line using training data, together with the other speech HMM parameters.

For a given speech gain $\bar{g}_n$, the PDF $f_{\bar{s}}(x_n|\bar{g}'_n)$ is considered to be a $\bar{p}$'th order zero mean Gaussian AR density function, equivalent to white Gaussian noise filtered by the all-pole AR model filter. The density function is given by (Eq. 7):

$$f_{\bar{s}}(x_n \mid \bar{g}'_n) = \frac{1}{(2\pi\bar{g}_n)^{\frac{K}{2}} |\bar{D}_{\bar{s}}|^{\frac{1}{2}}} \exp\left(-\frac{1}{2\bar{g}_n} x_n^{\#} \bar{D}_{\bar{s}}^{-1} x_n\right)$$

Where |•|| denotes the determinant, #| denotes the Hermitian transpose and the covariance matrix (Eq. 8):

$$\bar{D}_{\bar{s}} = (A_{\bar{s}}^{\#} A_{\bar{s}})^{-1},$$

where $A_{\bar{s}}$ is a K times K lower triangular Toeplitz matrix with the first $\bar{p}$+1 elements of the first column consisting of the AR coefficients including the leading one, $[1, \bar{\alpha}_1, \bar{\alpha}_2, \ldots, \bar{\alpha}_{\bar{p}}]^T$. According to a preferred embodiment each density function $f_{\bar{s}}$ corresponds to one type of speech. Then by making mixtures of the parameters it is possible to model more complex speech sounds.

1B. Noise Model

Elaborate noise models are useful to capture the high diversity and variability of acoustical noise. In the present embodiment, similar HMMs are used for speech and noise. The, model parameters for noise are denoted using double dots (instead of overbar for speech). For simplicity, we assume further that a single noise gain model, $f_{\ddot{s}}(\ddot{g}'_n)=f(\ddot{g}'_n)$, is shared by all HMM noise states. The noise PDF for a given state $\ddot{s}$ is (Eq. 9):

$$f_{\ddot{s}}(w_n) = \int_{-\infty}^{\infty} f(\ddot{g}'_n) f_{\ddot{s}}(w_n|\ddot{g}'_n) d\ddot{g}'_n \Bigg|$$

With the noise gain model given by (Eq. 10):

$$f(\ddot{g}'_n) = \frac{1}{\sqrt{2\pi\ddot{\psi}^2}} \exp\left(-\frac{1}{2\ddot{\psi}^2}(\ddot{g}'_n - \ddot{\phi}_n)^2\right) \Bigg|$$

i.e. with mean $\ddot{\phi}_n$ and variance $\ddot{\psi}^2$ being fixed for all noise states. The mean $\phi_n$ is in a preferred embodiment considered to be a time-varying parameter that models the unknown noise energy, and is to be estimated dynamically using the noisy observations. The variance $\ddot{\psi}^2$ and the remaining noise HMM parameters are considered to be time-invariant variables, which can be estimated off-line using recorded signals of the noise environment.

The simplified model implies that the noise gain and the noise shape, defined as the gain normalized noise spectrum, are considered independent. This assumption is valid mainly for continuous noise, where the energy variation can be generally modeled well by a global noise gain variable with time-varying statistics. The change of the noise gain is typically due to movement of the noise source or the recording device, which is assumed independent of the acoustics of the noise source itself. For intermittent or impulsive noise, the independent assumption is, however, not valid. State-dependent gain models can then be applied to model the energy differences in different states of the sound.

1C. Noisy Signal Model

The PDF of the noisy speech signal can be derived based on the assumed models of speech and noise. Let us assume that the speech HMM contains $|\bar{S}|$ states and the noise HMM $|\ddot{S}|$ states. Then, the noisy model is an HMM with $|\bar{S}|\cdot|\ddot{S}|$ states, where each composite state s consists of combinations of the state $\bar{s}$ of the speech component and the state $\ddot{s}$ of the noise component. The transition probabilities of the composite states are obtained using the transition probabilities in the speech and noise HMMs.

The noisy PDF corresponding to state s is (Eq. 11):

$$f_s(y_n) = \int\int f_s(y_n, \bar{g}'_n, \ddot{g}'_n)d\bar{g}'_n d\ddot{g}'_n = \int\int f_s(\bar{g}'_n)f(\ddot{g}'_n)f_s(y_n|\bar{g}'_n, \ddot{g}'_n)d\bar{g}'_n d\ddot{g}'_n$$

Where $f_s(y_n|\bar{g}'_n,\ddot{g}'_n)$ is a Gaussian PDF with zero-mean and covariance matrix $D_s$ given by (Eq. 12):

$$D_s=\bar{g}_n\bar{D}_s+\ddot{g}_n\ddot{D}_s.$$

The integral above may be evaluated numerically, e.g., by stochastic integration. However, in order to facilitate a substantially real-time implementation, $f_s(y_n|\bar{g}'_n,\ddot{g}'_n)$ is approximated by a scaled Dirac delta function (where it naturally is understood that the Dirac delta function is in fact not a function but a so called functional or distribution. However, since it has historically been (since Dirac's famous book on quantum mechanics) referred to as a delta-function we will also adapt this language throughout the text). We thus have (Eq. 13):

$$f_s(y_n, \bar{g}'_n, \ddot{g}'_n) \approx f_s(y_n, \bar{g}'_n, \ddot{g}'_n)\delta(\bar{g}'_n - \hat{\bar{g}}'_n)\delta(\ddot{g}'_n - \hat{\ddot{g}}'_n)$$

Where δ(•) denotes the Dirac delta function and (Eq. 14):

$$\{\hat{\bar{g}}'_n, \hat{\ddot{g}}'_n\} = \underset{\bar{g}'_n,\ddot{g}'_n}{\operatorname{argmax}} \log f_s(y_n, \bar{g}'_n, \ddot{g}'_n)$$

The noisy PDF of state s, $f_s(y_n)$, is then approximated to (Eq. 15):

$$f_s(y_n) \approx f_s(y_n, \hat{\bar{g}}'_n, \hat{\ddot{g}}'_n)$$

The approximation is valid if substantially the only significant peak of the integrand in the above mentioned integral is at $$\{\hat{\bar{g}}'_n, \hat{\ddot{g}}'_n\}$$

and the function decays rapidly from the peak. This behavior was, however, confirmed through simulations.

Speech Estimation

Now, we consider the enhancement of speech in noise by estimating speech from the observed noisy speech signal. According to the inventive method we consider a novel Bayesian speech estimator based on a criterion that results in an adjustable level of residual noise in the enhanced speech. The speech is estimated as (Eq. 16):

$$\hat{x}_n = \underset{\tilde{x}_n}{\operatorname{argmin}} E[C(X_n, W_n, \tilde{x}_n)|Y_0^n = y_0^n]$$

Where E[•] denotes the expectation and the Bayes risk is defined for the cost function (Eq. 17):

$$C(x_n, w_n, \tilde{x}_n)=||(x_n+\epsilon w_n)-\tilde{x}_n||^2$$

Where ||•|| denotes a suitably chosen vector norm and $0 \leqq \epsilon < 1$ defines an adjustable level of residual noise. The cost function is the squared error for the estimated speech compared to the clean speech plus some residual noise. By explicitly leaving some level of residual noise, the criterion reduces the processing artifacts, which are commonly associated with traditional speech enhancement systems known in the prior art. When ϵ is set to zero, the estimator is equal to the standard minimum mean square error (MMSE) speech waveform estimator. Using the Markov assumption, the posterior speech PDF given the noisy observations can be formulated as (Eq. 18):

$$f(x_n|y_o^n) = \frac{f(x_n, y_n|y_0^{n-1})}{f(y_n|y_0^{n-1})} = \frac{\sum_s \gamma_n(s)f_s(x_n, y_n)}{f(y_n|y_0^{n-1})}$$

$y_n(s)$ is the probability of being in the composite state $s_n$ given all past noisy observations up to block n−1 and it is given by (Eq. 19):

$$\gamma_n(s) = f(s_n|y_0^{n-1}) = \sum_{s_{n-1}} f(s_{n-1}|y_0^{n-1})a_{s_{n-1}s_n}$$

In which $f(s_{n-1}|y_0^{n-1})$ is the forward probability at block n−1, obtained using the forward algorithm.

Now applying the scaled delta function approximation, the posterior PDF can be rewritten as (Eq. 20):

$$f(x_n|y_0^n) = \frac{1}{\Omega_n}\sum_s \gamma_n(s)\int\int f_s(y_n, \bar{g}'_n, \ddot{g}'_n) f_s(x_n \mid y_n, \bar{g}'_n, \ddot{g}'_n)d\bar{g}'_n d\ddot{g}'_n \approx \frac{1}{\Omega_n}\sum_s \omega_n(s)f_s x_n|y_n, \hat{\bar{g}}'_n, \hat{\ddot{g}}'_n),$$

Where (Eq. 21):

$$\omega_n(s) = \gamma_n(s)f_s(y_n, \hat{\bar{g}}'_n, \hat{\ddot{g}}'_n),$$
$$\Omega_n = f(y_n|y_0^{n-1}) = \int f(x_n, y_n \mid y_0^{n-1})dx_n \approx \sum_s \gamma_n(s)f_s(y_n, \hat{\bar{g}}'_n, \hat{\ddot{g}}'_n) = \sum_s \omega_n(s).$$

By using the AR-HMM signal model, the conditional PDF $$f_s(x_n \mid y_n, \hat{\bar{g}}'_n, \hat{\ddot{g}}'_n)$$

for state s be shown to be a Gaussian distribution, with mean given by (Eq. 22):

$$E_s[X_n \mid Y'_n = y_n, \bar{g}'_n = \hat{\bar{g}}'_n, \ddot{g}'_n = \hat{\ddot{g}}'_n] = \hat{\bar{g}}_n\bar{D}_s(\hat{\bar{g}}_n\bar{D}_s + \hat{\ddot{g}}_n\ddot{D}_s)^{-1}y_n$$

Which is the Wiener filtering of $y_n$. The posterior noise PDF $f(w_n|y_0^n)$ has the same structure as the speech PDF, with $x_n$ replaced by $w_n$.

The Bayesian speech estimator can then be obtained as (Eq. 23):

$$\hat{x}_n = \int x_n f(x_n|y_0^n)dx_n + \epsilon \int w_n f(w_n|y_0^n)dw_n$$
$$= H_n y_n,$$

where $H_n$ is given by the following two equations ((Eq. 24a) and (Eq. 24b)):

$$H_n = \frac{1}{\Omega_n}\sum_s \omega_n(s)H_s$$
$$H_s = (\hat{g}_n\bar{D}_s + \epsilon\hat{g}_n\ddot{D}_s)(\hat{g}_n\bar{D}_s + \hat{g}_n\ddot{D}_s)^{-1}.$$

The above mentioned speech estimator $\hat{x}_n$ can be implemented efficiently in the frequency domain, for example by assuming that the covariance matrix of each state is circulant. This assumption is asymptotically valid, e.g. when the signal block length K is large compared to the AR model order $\bar{p}$.

1D. Off-line Parameter Estimation

The training of the speech and noise HMM with gain models can be performed off-line using recordings of clean speech utterances and different noise environments. The training of the noise model may be simplified by the assumption of independence between the noise gain and shape. The off-line training of the noise can be performed using the standard Baum-Welch algorithm using training data normalized by the long-term averaged noise gain. The noise gain variance $\ddot{\psi}^2$ may be estimated as the sample variance of the logarithm of the excitation variances after the normalization.

The parameters of the speech HMM, $\bar{\theta}=\{\bar{a}, \bar{\phi}, \bar{\psi}^2, \bar{\alpha}\}$, are to be estimated using a training set that consists of R speech utterances. This training set is assumed to be sufficiently rich such that the general characteristics of speech are well represented. In addition, estimation of the speech gain bias $\bar{q}$ is necessary in order to calculate the likelihood score from the training data. For simplicity, it is assumed that the speech gain, bias is constant for each training utterance. $\bar{q}(r)$ is used to denote the speech gain bias of the r'th utterance. The block index n is now dependent on r, but this is not explicitly shown in the notation for simplicity.

The parameters of interest are denoted $\theta=\{\bar{\theta},\bar{q}\}$ and they are optimized in the maximum likelihood sense. Similarly to the Baum-Welch algorithm, an iterative algorithm based on the expectation-maximization (EM) framework is proposed. The EM based algorithm is an iterative procedure that improves the log likelihood score with each iteration. To avoid convergence to a local maximum, several random initializations are performed in order to select the best model parameters. The EM algorithm is particularly useful when the observation sequence is incomplete, i.e., when the estimator is difficult to solve analytically without additional observations. In this case, the missing data is considered to be $Z_0^{N-1}=\{\bar{s}_0^{N-1}, \bar{g}_0^{N-1}\}$, which are the sequence of the underlying states and speech gains.

The maximization step in the EM algorithm finds new model parameters that maximize the auxiliary function $Q(\theta|\theta^{j-1})$ from the expectation step (Eq. 25):

$$\hat{\theta}^{(j)} = \underset{\theta}{\operatorname{argmax}} Q(\theta|\hat{\theta}^{(j-1)})$$
$$= \underset{\theta}{\operatorname{argmax}} \int_{z_0^{N-1}} f(z_0^{N-1}|x_0^{N-1}, \hat{\theta}^{(j-1)}) \log(f(z_0^{N-1}, x_0^{N-1}|\theta))dz_0^{N-1},$$

where j denotes the iteration index.

It can be shown that the auxiliary function $Q(\theta|\theta^{j-1})$ can be rewritten as (Eq. 26):

$$Q(\theta|\hat{\theta}^{(j-1)}) = O(\theta|\hat{\theta}^{(j-1)}) + \sum_{r,n,\bar{s}} \bar{\omega}_n(\bar{s}) \int f_{\bar{s}}(\bar{g}_n'|x_n, \hat{\theta}^{(j-1)}) (\log f_{\bar{s}}(\bar{g}_n'|\theta) + \log f_{\bar{s}}(x_n|\bar{g}_n', \theta))d\bar{g}_n',$$

where the summations are over R utterances, N, blocks of each utterance and $\bar{S}$ states. The posterior state probability is given by (Eq. 27):

$$\bar{\omega}_n(\bar{s}) \doteq f(\bar{s}_n|x_O^{N-1}, \hat{\theta}^{(j-1)})|$$

The posterior probability may be evaluated using the forward-backward algorithm (see e.g. L. Rabiner, "A tutorial on hidden Markov models and selected applications in speech recognition," Proceedings of the IEEE, vol. 77, no. 2, pp. 257-286, February 1989.).

$O(\theta|\hat{\theta}^{j-1})$ contains all the terms associated with the parameters $\{\bar{\alpha}\}$, which can be optimized following the standard Baum-Welch algorithm.

Differentiating (Eq. 26) with respect to the variables of interests and setting the resulting expression to zero, we can obtain the update equations for the j'th iteration. It turns out that the gradient terms with respect to $\{\bar{\phi}, \bar{\psi}^2\}$ and $\bar{q}_r$, are not easily separable. Hence, an iterative estimation of $\bar{q}_r$ and $\bar{\theta}$ is performed. Assuming a fixed $\bar{q}_r$, the update equations for $\{\bar{\phi}, \bar{\psi}^2\}$ are given by (Eq. 28a and Eq. 28b):

$$\bar{\phi}_{\bar{s}}^{(j)} = \frac{1}{\bar{\Omega}}\sum_{r,n} \bar{\omega}_n(\bar{s}) \int \bar{g}_n' f_{\bar{s}}(\bar{g}_n'|x_n, \hat{\theta}^{(j-1)})d\bar{g}_n' - \bar{q}_r$$
$$\bar{\psi}_{\bar{s}}^{2(j)} = \frac{1}{\bar{\Omega}}\sum_{r,n} \bar{\omega}_n(\bar{s}) \int (\bar{g}_n' - \bar{\phi}_{\bar{s}}^{(j)} - \bar{q}_r)^2 f_{\bar{s}}(\bar{g}_n'|x_n, \hat{\theta}^{(j-1)})d\bar{g}_n'$$

Where $\bar{\Omega}$ is given by (Eq. 29):

$$\bar{\Omega} = \sum_{r,n} \bar{\omega}_n(\bar{s}).$$

The AR coefficients, $\bar{\alpha}$, can be obtained from the estimated autocorrelation sequence by applying the Levinson-Durbin recursion algorithm. Under the assumption of large K. The autocorrelation sequence can be estimated as (Eq. 30):

$$\bar{r}_{ns}^{(j)}[i] = \frac{1}{\bar{\Omega}}\sum_{r,n} \bar{\omega}_n(\bar{s}) r_{x_n}[i] \int (\bar{g}_n)^{-1} f_{\bar{s}}(\bar{g}_n'|x_n, \hat{\theta}^{(j-1)})d\bar{g}_n',$$

where (Eq. 31)

$$r_{x_n}[i] = \sum_{j=0}^{K-i-1} x_n[j]x_n[j+i].$$

For given $\overline{\theta}$, the update equation for $\overline{q}_r$ may be written as (Eq. 32):

$$\overline{q}_r^{(j)} = \frac{1}{\overline{\Omega}'}\sum_{n,s}\frac{\overline{\omega}_n(\overline{s})}{\overline{\psi}_s^2}\left(\int \overline{g}'_n f_s(\overline{g}'_n|x_n, \hat{\theta}^{(j-1)})d\overline{g}'_n - \overline{\phi}_s\right),$$

where $\overline{\Omega}'$ is given by (Eq. 33)

$$\overline{\Omega}' = \sum_{n,s}\overline{\omega}_n(\overline{s})/\overline{\psi}_s^2.$$

By optimizing the EM criterion, the likelihood score of the parameters is non-decreasing in each iteration step. Consequently, the iterative optimization will converge to model parameters that locally maximize the likelihood. The optimization is terminated when two consecutive likelihood scores are sufficiently close to each other.

The update equations contain several integrals that are difficult to solve analytically. One solution is to use the numerical techniques such as stochastic integration. In one of the sections below, a solution is proposed by approximating the function $f_s(\overline{g}'_n|x_n)$ using the Taylor expansion.

EM Based Solution to Eq. 14

The evaluation of the proposed speech estimator (given by Eq. 16) requires solving the maximization problem (given by Eq. 14) for each state. In this section a solution based on the EM algorithm is proposed. The problem corresponds to the maximum a posteriori estimation of $\{\overline{g}_n, \ddot{g}_n\}$ for a given state s. We assume that the missing data of interests are $x_n$ and $w_n$. We solve for $$\{\hat{\overline{g}}'_n, \hat{\ddot{g}}'_n\}$$

that maximizes the $\underset{\sim}{Q}$ function following the standard EM formulation. The optimization condition with respect to the speech gain $\overline{g}'_n$ of the j'th iteration is given by (Eq. 34):

$$\frac{1}{2}\frac{R_x^{(j-1)}}{\exp(\hat{\overline{g}}_n'^{(j)})} - \frac{\hat{\overline{g}}_n'^{(j)} - \overline{\phi}_s - \overline{q}_n}{\overline{\psi}_s^2} - \frac{K}{2} = 0$$

Where (Eq. 35)

$$R_x^{(j-1)} = \int f(x_n|y_n, \hat{\theta}^{(j-1)})x_n^T\overline{D}_s^{-1}x_n dx_n,$$

which is the expected residual variance of the speech filtered through the inverse filter. The condition equation of the noise gain $\ddot{g}_n$ has the similar structure as (Eq. 34) with x replaced by w. The equations can be solved using the so called Lambert W function. Rearranging the terms in (Eq. 34), we obtain (Eq. 36)

$$\hat{\overline{g}}_n'^{(j)} = \overline{\phi}_s + \overline{q}_n - \frac{K\overline{\psi}_s^2}{2} + W_0\left(\frac{\overline{\psi}_s^2 R_x^{(j-1)}}{2}\exp\left(\frac{K\overline{\psi}_s^2}{2} - \overline{\phi}_s - \overline{q}_n\right)\right),$$

where $W_0(\bullet)$ denotes the principle branch of the Lambert W function. Since the input term to $W_0(\bullet)$ is real and nonnegative, only the principle branch is needed and the function is real and nonnegative. Efficient implementation of $W_0(\bullet)$ is discussed in D. A. Barry, P. J. Culligan-Hensley, and S. J. Barry, "Real values of the W-function," ACM Transactions on Mathematical Software, vol. 21, no. 2, pp. 161-171, June 1995, which is hereby incorporated by reference in its entirety. When the gain variance is large compared to the mean, taking the exponential function of (Eq. 36) may result in values out of the numerical range of a computer. This can be prevented by ignoring the second term in (Eq. 34) when the variance is too large. The approximation is equivalent to assuming uniform prior, which is reasonable for large variance.

Approximation of $f_s(\overline{g}'_n|x_n)$

In order to simplify the integrals in (Eq. 28a, 28b, 30 and 32) an approximation of $f_s(\overline{g}'_n|x_n)$ is proposed. Let $f_s(\overline{g}'_n|x_n)=C^{-1}f_s(\overline{g}'_n,x_n)$ for $C=f_s(x_n)=\int f_s(\overline{g}'_n,x_n)d\overline{g}'_n$, it can be shown that the second derivative of $\log f_s(\overline{g}'_n|x_n)$ with respect to $\overline{g}'_n$ is negative for all $\overline{g}'_n$, which suggests that $f_s(\overline{g}'_n|x_n)$ is a log-concave function and, thus, a unique maximum exists. The function $f_s(\overline{g}'_n|x_n)$ is approximated by applying the $2^{nd}$ order Taylor expansion of $\log f_s(\overline{g}'_n|x_n)$ around its mode $$\hat{\overline{g}}'_n,$$

and enforce proper normalization. The resulting PDF is a Gaussian distribution (Eq. 37):

$$f_s(\overline{g}'_n|x_n) \approx \left(2\pi\overline{A}_n^2(\overline{s})\right)^{-\frac{1}{2}}\exp\left(-\frac{1}{2\overline{A}_n^2(\overline{s})}\left(\overline{g}'_n - \hat{\overline{g}}'_n\right)^2\right),$$

for $$\hat{\overline{g}}'_n = \underset{\overline{g}'}{\operatorname{argmax}}\log f_s(\overline{g}'_n|x_n) \quad \text{(Eq. 38)}$$

and $$\overline{A}_n^2(\overline{s}) = -\left(\frac{\partial^2\log f_s(\overline{g}'_n|x_n)}{\partial\overline{g}_n'^2}\right)^{-1}\Bigg|_{\overline{g}'_n=\hat{\overline{g}}'_n}. \quad \text{(Eq. 39)}$$

Now applying the approximated Gaussian PDF, the integrals in (Eq. 4, 28a, 28b, 30 and 32) can be solved analytically.

The maximizing $$\hat{\overline{g}}'_n$$

can be obtained by setting the first derivative of $\log f_s(\overline{g}'_n|x_n)$ to zero and solve for $\overline{g}'_n$. We obtain (Eq. 40):

$$\frac{1}{2}\frac{x_n^T\overline{D}_s^{-1}x_n}{\exp(\hat{\overline{g}}'_s)} - \frac{\hat{\overline{g}}'_s - \overline{\phi}_s - \overline{q}_n}{\psi_s^2} - \frac{K}{2} = 0,$$

which again can be solved using the Lambert W function similarly as (Eq. 34).

1E. Dynamical Parameter Estimation

The time-varying parameters $\theta=\{\overline{q}_n,\ddot{\phi}_n\}$ as defined in (Eq. 5b) and (Eq. 10) are to be estimated dynamically using the observed noisy data. In addition, we restrict to the real-time constraint such that no additional delay is required by the estimation algorithm. Under the assumption that the model parameters vary slowly, a recursive EM algorithm is applied to perform the dynamical parameter estimation. That is, the parameters are updated recursively for each observed noisy data block, such that the likelihood score is improved on average.

The recursive EM algorithm may be a technique based on the so called Robbins-Monro stochastic approximation principle, for parameter re-estimation that involves incomplete or unobservable data. The recursive EM estimates of time-invariant parameters may be shown to be consistent and asymptotically Gaussian distributed under certain suitable conditions. The technique is applicable to estimation of time-varying parameters by restricting the effect of the past observations, e.g. by using forgetting factors. Applied to the estimation of the HMM parameters. The Markov assumption makes the EM algorithm tractable and the state probabilities may be evaluated using the forward-backward algorithm. To facilitate low complexity and low memory implementation for the recursive estimation, a so called fixed lag estimation approach is used, where the backward probabilities of the past states are neglected.

Let $z_n=\{s_n, \bar{g}_n, \ddot{g}_n\}$ denote the hidden variables. The recursive EM algorithm optimizes for the auxiliary function defined as (Eq. 41):

$$Q_n(\theta|\hat{\theta}_0^{n-1})=\int_{z_0^n} f(z_0^n|y_0^n,\hat{\theta}_0^{n-1})\log(f(z_0^n,y_0^n|\theta))dz_0^n,$$

where (Eq. 42)

$$\hat{\theta}_0^{n-1}=\{\hat{\theta}_j\}_{j=0\ldots n-1}$$

denotes the estimated parameters from the first block to the (n−1)'th block. It can then be shown that the Q function given by (Eq. 41) can be approximated as (Eq. 43):

$$Q_n(\theta|\hat{\theta}_0^{n-1}) \approx \sum_{t=0}^{n} \mathcal{L}_t(\theta|\hat{\theta}_0^{t-1})$$

with $$\mathcal{L}_t(\theta|\hat{\theta}_0^{t-1}) \approx \sum_s \frac{\gamma_t(s)}{\Omega_t} \int\int f_s(y_t, \bar{g}_t', \ddot{g}_t'|\hat{\theta}_{t-1})(\log f_s(\bar{g}_t'|\theta) + \log f(\ddot{g}_t'|\theta))d\bar{g}_t' d\ddot{g}_t', \quad \text{(Eq. 44)}$$

where the irrelevant terms with respect to the parameters of interest have been neglected. Applying the Dirac delta function approximation from (Eq. 13) we get (Eq. 45):

$$\mathcal{L}_t(\theta|\hat{\theta}_0^{t-1}) \approx \sum_s \frac{\gamma_t(s)}{\Omega_t} f_s(y_t, \hat{\bar{g}}_t', \hat{\ddot{g}}_t'|\hat{\theta}_{t-1})(\log f_s(\hat{\bar{g}}_t'|\theta) + \log f(\hat{\ddot{g}}_t'|\theta)).$$

The recursive estimation algorithm optimizing the Q function can be implemented using the stochastic approximation technique. The update equations for the parameters have the form (Eq. 46)

$$\hat{\theta}_n = \theta + \left(-\frac{\partial^2 Q_n(\theta|\hat{\theta}_0^{n-1})}{\partial\theta^2}\right)^{-1} \frac{\partial L(\theta|\hat{\theta}_0^{n-1})}{\partial\theta}\Bigg|_{\theta=\hat{\theta}_{n-1}}.$$

Taking the first and second derivatives of the auxiliary functions, the update equations can be solved analytically to (Eq. 47) and (Eq. 48) given below:

$$\hat{\bar{\phi}}_n = \hat{\bar{\phi}}_{n-1} + \frac{1}{\Xi_n}\sum_s \frac{\omega_n(s)}{\Omega_n}(\hat{\bar{g}}_n' - \hat{\bar{\phi}}_{n-1})$$

$$\hat{\bar{q}} = \hat{\bar{q}}_{n-1} + \frac{1}{\Xi_n'}\sum_s \frac{\omega_n(s)}{\Omega_n \bar{\psi}_s^2}(\hat{\bar{g}}_n' - \bar{\phi}_s - \hat{\bar{q}}_{n-1}),$$

where $$\Xi_n = \sum_{t=0}^{n}\sum_s (\omega_t(s)/\Omega_t) = n+1 \text{ and } \Xi_n' = \sum_{t=0}^{n}\sum_s (\omega_t(s)/\Omega_t\psi_s^2)$$

are two non-decreasing normalization terms that control the impact of one new observation for increased number of past observations. As the parameters are considered time-varying, we apply exponential forgetting factors to the normalization term, to decrease the impact of the results from the past. Hence, the modified normalization terms are evaluated by recursive summation of the past values (Eq. 49) and (Eq. 50):

$$\Xi_n = \rho_{\bar{\phi}}\Xi_{n-1} + 1$$

$$\Xi_n' = \rho_{\bar{q}}\Xi_{n-1}' + \sum_s \frac{\omega_n(s)}{\Omega_n\bar{\psi}_s^2},$$

where $0 \leqq \rho_{\bar{\phi}}, \rho_{\bar{q}} \leqq 1$ are two exponential forgetting factors. When these two forgetting factors are equal to 1, the situation corresponds to no forgetting.

1F. Experiments and Results

In this section the implementation details of the above mentioned embodiment of the inventive method of using parameterization by AR coefficients (for details se e.g. section 1A-1E) in a system shown in FIG. 1 is more closely described, wherein the advantages of the inventive method is compared with prior art methods of speech enhancement.

System Implementation

The proposed speech enhancement system shown in FIG. 1 is in an embodiment implemented for 8 kHz sampled speech. The system uses the HMM based speech and noise models 4 and 6 described in section in more detail in sections 1A and 1B above. The HMMs are implemented using Gaussian mixture models (GMM) in each state. The speech HMM consists of eight states and 16 mixture components per state, with AR models of order ten. The training data for speech consists of 640 clean utterances from the training set of the TIMIT database down-sampled to 8 kHz. A set of pre-trained noise HMMs are used each describing a particular noise environment. It is preferable to have a limited noise model that describes the current noise environment, than a general noise model that covers all possible noises. A number of noise models were trained, each describing one typical noise environment. Each noise model had three states and three mixture components per state. All noise models use AR models of order six, with the exception of the babble noise model, which is of order ten, motivated by the similarity of its spectra to speech. The noise signals used in the training were not used in the evaluation. During enhancement, the first 100 ms of the noisy signal is assumed to be noise only, and is used to select one active model from the inventory (codebook) of noise models. The selection is based on the maximum likelihood criterion. The forgetting factors for adapting the time-varying gain model parameters are experimentally set to $\rho_{\bar{\phi}}=0.9$ and $\rho_{\bar{q}}=0.99$. With these forgetting factors, as well as with other settings, the dynamical parameter estimation method (section 1E) was found to be numerically stable in all of the evaluations.

The noisy signal is processed in the frequency domain in blocks of 32 ms windowed using Hanning (von Hann) window. Using the approximation that the covariance matrix of each state is circulant, the estimator (Eq. 23) can be implemented efficiently in the frequency domain. The covariance matrices are then diagonalized by the Fourier transformation matrix. The estimator corresponds to applying an SNR dependent gain-factor to each of the frequency bands of the observed noisy spectrum. The gain-factors are obtained as in (Eq. 24a), with the matrices replaced by the frequency responses of the filters (Eq. 24b). The synthesis is performed using 50% overlap-and-add.

The computational complexity is one important constraint for applying the proposed method in practical environments. The computational complexity of the proposed method is roughly proportional to the number of mixture components in the noisy model. Therefore, the key to reduce the complexity is pruning of mixture components that are unlikely to contribute to the estimators. In our implementation, we keep 16 speech mixture components in every block, and the selection is according to the likelihood scores calculated using the most likely noise component of the previous block.

Experimental Setup

The evaluation is performed using the core test set of the TIMIT database (192 sentences) re-sampled to 8 kHz. The total length of the evaluation utterances is about ten minutes. The noise environments considered are: traffic noise, recorded on the side of a busy freeway, white Gaussian noise, babble noise (Noisex-92), and white-2, which is amplitude modulated white Gaussian noise using a sinusoid function. The amplitude modulation simulates the change of noise energy level, and the sinusoid function models that the noise source periodically passes by the microphone. The sinusoid has a period of two seconds, and the maximum amplitude of the modulation is four times higher than the minimum amplitude. The noisy signals are generated by adding the concatenated speech utterances to noise for various input SNRs. For all test methods, the utterances are processed concatenated.

Objective evaluations of the proposed method are described in the next three sub-sections. The reference methods for the objective evaluations are the HMM based MMSE method (called ref. A), reported in Y. Ephraim, "A Bayesian estimation approach for speech enhancement using hidden Markov models", *IEEE Trans. Signal Processing*, vol. 40, no. 4, pp. 725-735, April 1992, the gain-adaptive HMM based MAP method (called ref. B), reported in Y. Ephraim, "Gain-adapted hidden Markov models for recognition of clean and noisy speech", *IEEE Trans. Signal Processing*, vol. 40, no. 6, pp. 1303-1316, June 1992, which hereby is incorporated by reference in its entirety, and the HMM based MMSE method using HMM-based noise adaptation (called ref. C), reported in H. Sameti et al., "HMM-based strategies for enhancement of speech signals embedded in nonstationary noise", *IEEE Trans. Speech and Audio Processing*, vol. 6, no. 5, pp. 445-455, September 1998. The reference methods are implemented using shared codes and similar parameter setups whenever possible to minimize irrelevant performance mismatch. The ref. A and B methods require, however, a separate noise estimation algorithm, and the method based on minimum statistics known in the art is used. The gain contour estimation of ref. B is performed according to the one reported in Y. Ephraim, "Gain-adapted hidden Markov models for recognition of clean and noisy speech", *IEEE Trans. Signal Processing,* vol. 40, no. 6, pp. 1303-1316, June 1992. The ref. C method requires a VAD (voice activity detector) for noise classification and gain adaptation, and we use the ideal VAD estimated from the clean signal. The global gain factor used in ref. A and C, which compensates for the speech model energy mismatch, is estimated according to the method disclosed in Y. Ephraim, "A Bayesian estimation approach for speech enhancement using hidden Markov models", *IEEE Trans. Signal Processing*, vol. 40, no. 4, pp. 725-735, April 1992.

The objective measures considered in the evaluations are signal-to-noise ratio (SNR), segmental SNR (SSNR), and the Perceptual Evaluation of Speech Quality (PESQ). For the SSNR measure, the low energy blocks (40 dB lower than the long-term power level) are excluded from the evaluation. The measures are evaluated for each utterance separately and averaged over the utterances to get the final scores. The first utterance is removed from the averaging to avoid biased results due to initializations. As the input SNR is defined over all utterances concatenated, there is a small deviation in the evaluated SNR of the noisy signals in the results presented in TABLE 1 below.

TABLE I

EXPERIMENTAL RESULTS FOR NOISY SPEECH SIGNALS OF 10-DB INPUT SNR USING MMSE WAVEFORM ESTIMATORS (REF. B IS A MAP ESTINATOR).

| Type | Noisy | Sys. | Ref. A | Ref. B | Ref. C |
|---|---|---|---|---|---|
| | | SNR (dB) | | | |
| white | 10.00 | 15.38 | 15.03 | 14.42 | 15.13 |
| traffic | 10.62 | 15.10 | 13.40 | 13.81 | 13.54 |
| babble | 10.21 | 13.45 | 12.42 | 12.41 | 11.06 |
| white-2 | 10.04 | 15.20 | 11.71 | 11.46 | 13.27 |
| | | SSNR (dB) | | | |
| white | 0.49 | 8.06 | 7.33 | 5.28 | 7.78 |
| traffic | 1.73 | 8.01 | 5.74 | 5.82 | 6.15 |
| babble | 1.25 | 6.13 | 4.57 | 4.16 | 4.04 |
| white-2 | 2.11 | 8.21 | 4.66 | 4.19 | 6.24 |
| | | PESQ (MOS) | | | |
| white | 2.16 | 2.86 | 2.72 | 2.61 | 2.78 |
| traffic | 2.50 | 2.97 | 2.75 | 2.76 | 2.70 |
| babble | 2.54 | 2.78 | 2.59 | 2.69 | 2.35 |
| white-2 | 2.24 | 2.76 | 2.43 | 2.40 | 2.42 |

Evaluation of the Modeling Accuracy

One of the objects of the present embodiments is to improve the modeling accuracy for both speech and noise. The improved model is expected to result in improved speech enhancement performance. In this experiment, we evaluate the modeling accuracy of the methods by evaluating the log-likelihood (LL) score of the estimated speech and noise models using the true speech and noise signals.

The LL score of the estimated speech model for the n'th block is defined as (Eq. 50):

$$LL(x_n) = \log\left(\frac{1}{\Omega_n}\sum_s \omega_n(s)\hat{f}_s(x_n)\right),$$

where the weight $\Omega_n$ is the state probability given the observations $y_0^n$, and $$\hat{f}_s(x_n) = f_s(x_n|\hat{g}_n)$$

is the density function (Eq. 8) evaluated using the estimated speech gain $$\hat{g}_n.$$

The likelihood score for noise is defined similarly. The values are then averaged over all utterances to obtain the mean value. The low energy blocks (30 dB lower than the long-term power level) are excluded from the evaluation for the numerical stability.

Figure 2:
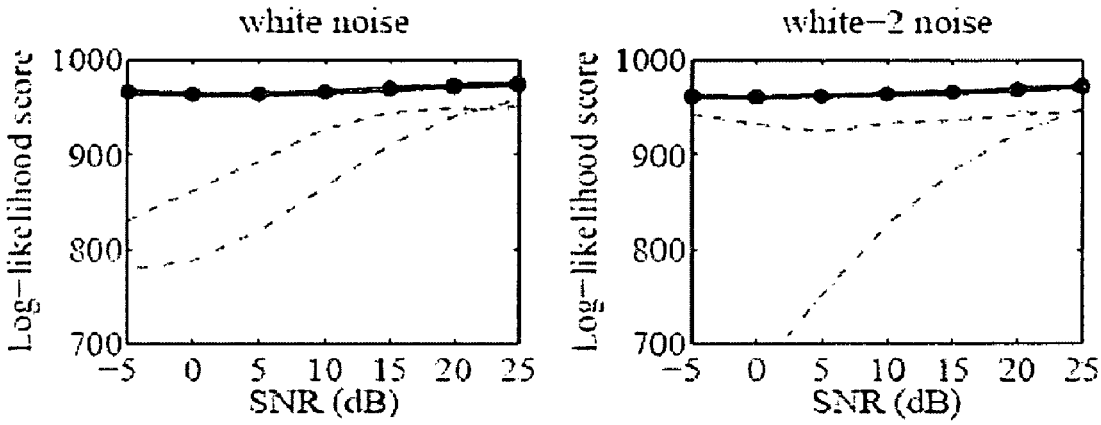
FIG. 2 shows the log likelihood (LL) scores of the speech models estimated from noisy observations compared with prior art methods.
Figure 3:
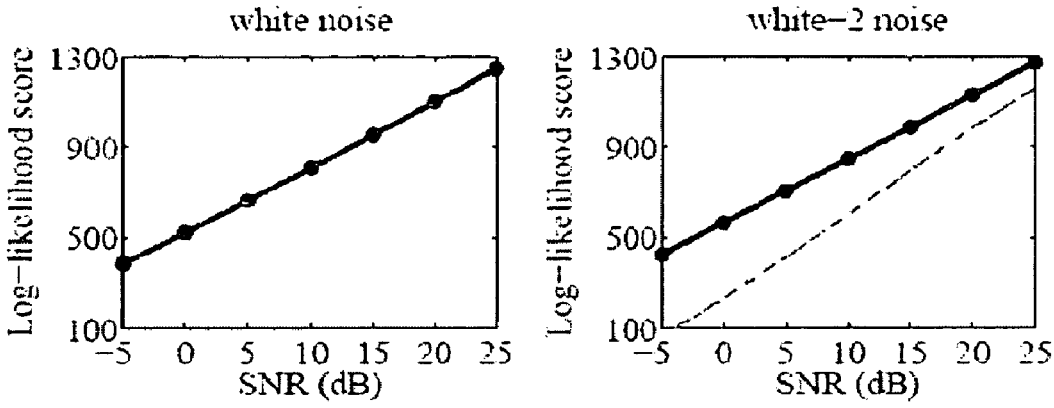
FIG. 3 shows the log likelihood (LL) scores of the noise models estimated from noisy observations compared with prior art methods.

The LL scores for the white and white-2 noises as functions of input SNRs are shown in FIG. 2 for the speech model and FIG. 3 for the noise model. The proposed method is shown in solid lines with dots, while the reference methods A, B and C are dashed, dash-dotted and dotted lines, respectively. The proposed method is shown to have higher scores than all reference methods for all input SNRs. Surprisingly, the ref. B method performs poorly, particularly for low SNR cases. This may be due to the dependency on the noise estimation algorithm, which is sensitive to input SNR. As for the noise modeling, the performance of all the methods is similar for the white noise case. This is expected due to the stationarity of the noise. For the white-2 noise, the ref. C method performs better than the other reference methods, due to the HMM-based noise modeling. The proposed method has higher LL scores than all reference methods, as results from the explicit noise gain modeling.

Objective Evaluation of MMSE Waveform Estimators

The improved modeling accuracy is expected to lead to increased performance of the speech estimator. In this experiment, we evaluate the MMSE waveform estimator by setting the residual noise level $\epsilon$ to zero. The MMSE waveform estimator optimizes the expected squared error between clean and reconstructed speech waveforms, which is measured in terms of SNR. Note that the ref. B method is a MAP estimator, optimizing for the hit-and-miss criterion known from estimation theory.

Figure 4:
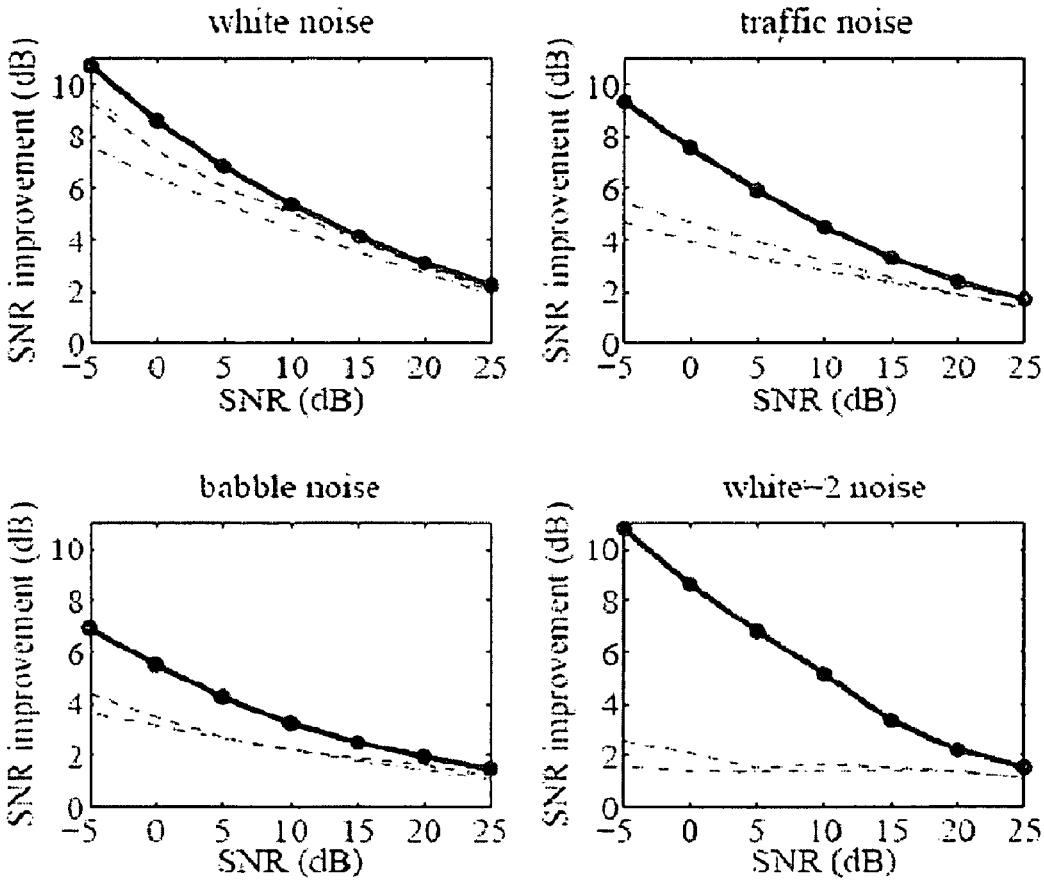
FIG. 4 shows SNR improvements in dB as function of input SNRs, where the solid line is obtained from the inventive method and the dash-doted and doted lines are obtained from prior art methods.

The SNR improvements of the methods as functions of input SNRs for different noise types are shown in FIG. 4. The estimated speech of the proposed method has consistently higher SNR improvement than the reference methods. The improvement is significant for non-stationary noise types, such as traffic and white-2 noises. The SNR improvement for the babble noise is smaller than the other noise types, which is partly expected from the similarity of the speech and noise.

The results for the SSNR measure are consistent with the SNR measure, where the improvement is significant for non-stationary noise types. While the MMSE estimator is not optimized for any perceptual measure, the results from PESQ show consistent improvement over the reference methods.

Perceptual Quality Evaluation

The objective evaluation in the previous subsections demonstrates the advantage of explicit gain modeling for HMM-based speech enhancement. Below, it is shown how the proposed inventive method can be used in a practical speech enhancement system such as depicted in FIG. 1. The perceptual quality of the system was evaluated through listening tests. To make the tests relevant, the reference system must be perceptually well tuned (preferably a standard system). Hence, the noise suppression module of the Enhanced Variable Rate Codec (EVRC) was selected as the reference system.

The proposed Bayesian speech estimator given by (Eq. 16) facilitates adjustment of the residual noise level, $\epsilon$. While the objective results (TABLE 1) indicate good SNR/SSNR performance for $\epsilon=0$, it has been found experimentally that $\epsilon=0.15$ forms a good trade-off between the level of residual noise and audible speech distortion and this value was used in the listening tests.

The AR-based speech HMM does not model the spectral fine structure of voiced sounds in speech. Therefore, the estimated speech using (Eq. 23) may exhibit some low-level rumbling noise in some voiced segments, particularly high-pitched speakers. This problem is inherent for AR-HMM-based methods and is well documented. Thus, the method is further applied to enhance the spectral fine-structure of voiced speech.

The subjective evaluation was performed under two test scenarios: 1) straight enhancement of noisy speech, and 2) enhancement in the context of a speech coding application. Noisy speech signals of input SNR 10 dB were used in both tests. The evaluations are performed using 16 utterances from the core test set, one male and one female speaker from each of the eight dialects. The tests were set up similarly to a so called Comparison Category Rating (CCR) test known in the art. Ten listeners participated in the listening tests. Each listener was asked to score a test utterance in comparison to a reference utterance on an integer scale from −3 to +3, corresponding to much worse to much better. Each pair of utterances was presented twice, with switched order. The utterance pairs were ordered randomly.

1) Evaluation of Speech Enhancement Systems:

The noisy speech signals were pre-processed by the 120 Hz high-pass filter from the EVRC system. The reference signals were processed by the EVRC noise suppression module. The encoding/decoding of the EVRC codec was not performed. The test signals were processed using the proposed speech estimator followed by the spectral fine-structure enhancer (as shown in for example: "Methods for subjective determination of transmission quality", ITU-T Recommendation P.800, August 1996, which is hereby incorporated by reference in its entirety). To demonstrate the perceptual importance of the spectral fine-structure enhancement, the test was also performed without this additional module. The mean CCR scores together with the 95% confidence intervals are presented in TABLE 2 below.

TABLE 2

| | White | traffic | babble | White-2 |
|---|---|---|---|---|
| With fine-structure enhancer | 0.95 ± 0.10 | 1.22 ± 0.13 | 0.39 ± 0.14 | 1.43 ± 0.13 |
| Without fine-structure enhancer | 0.60 ± 0.12 | 0.77 ± 0.16 | −0.22 ± 0.14 | 0.96 ± 0.14 |

Scores from the CCR listening test with 95% confidence intervals (10 dB input SNR). The scores are rated on an integer scale from −3 to 3, corresponding to much worse to much better. Positive scores indicate a preference for the proposed system.

The CCR scores show a consistent preference to the proposed system when the fine-structure enhancement is performed. The scores are highest for the traffic and white-2 noises, which are non-stationary noises with rapidly time-varying energy. The proposed system has a minor preference for the babble noise, consistent with the results from the objective evaluations. As expected, the CCR scores are reduced without the fine-structure enhancement. In particular, the noise level between the spectral harmonics of voiced speech segments was relatively high and this noise was perceived as annoying by the listeners. Under this condition, the CCR scores still show a positive preference for the white, traffic and white-2 noise types.

2) Evaluation of Enhancement in the Context of Speech Coding

In the following test, the reference signals were processed by the EVRC speech codec with the noise suppression module enabled. The test signals were processed by the proposed speech estimator (without the fine-structure enhancements as the preprocessor to the EVRC codec with its noise suppression module disabled. Thus, the same speech codec was used for both systems in comparison, and they differ only in the applied noise suppression system. The mean CCR scores together with the 95% confidence intervals are presented in TABLE 3 below.

TABLE 3

| white | traffic | babble | white-2 |
|---|---|---|---|
| 0.62 ± 0.12 | 0.92 ± 0.15 | 0.02 ± 0.13 | 0.98 ± 0.14 |

Scores from the CCR listening test with 95% confidence interval (10 dB input SNR). The noise suppression systems were applied as pre-processors to the EVRC speech codec. The scores are rated on an integer scale from −3 to 3, corresponding to much worse to much better. Positive scores indicate a preference for the proposed system.

The test results show a positive preference for the white, traffic and white-2 noise types. Both systems perform similarly for the babble noise condition.

The results from the subjective evaluation demonstrate that the perceptual quality of the proposed speech enhancement system is better or equal to the reference system. The proposed system has a clear preference for noise sources with rapidly time-varying energy, such as traffic and white-2 noises, which is most likely due to the explicit gain modeling and estimation. The perceptual quality of the proposed system can likely be further improved by additional perceptual tuning.

It has thus been demonstrated that the new HMM-based speech enhancement method using explicit speech and noise gain modeling is feasible and outperforms all other systems known in the art. Through the introduction of stochastic gain variables, energy variation in both speech and noise is explicitly modeled in a unified framework. The time-invariant model parameters are estimated off-line using the expectation-maximization (EM) algorithm, while the time-varying parameters are estimated dynamically using the recursive EM algorithm. The experimental results demonstrate improvement in modeling accuracy of both speech and (non-stationary) noise statistics. The improved speech and noise models were applied to a novel Bayesian speech estimator that is constructed from a cost function. The combination of improved modeling and proper choice of optimization criterion was shown to result in consistent improvement over the reference methods. The improvement is significant for non-stationary noise types with fast time-varying energy, but is also valid for stationary noise. The performance in terms of perceptual quality was evaluated through listening tests. The subjective results confirm the advantage of the proposed scheme.

Noise Model Estimation Using SG-HMM

In an alternative embodiment of the inventive method it is hereby proposed a noise model estimation method using an adaptive non-stationary noise model, and wherein the model parameters are estimated dynamically using the noisy observations. The model entities of the system consist of stochastic-gain hidden Markov models (SG-HMM) for statistics of both speech and noise. A distinguishing feature of SG-HMM is the modeling of gain as a random process with state-dependent distributions. Such models are suitable for both speech and non-stationary noise types with time-varying energy. While the speech model is assumed to be available from off-line training, the noise model is considered adaptive and is to be estimated dynamically using the noisy observations. The dynamical learning of the noise model is continuous and facilitates adaptation and correction to changing noise characteristics. Estimation of the noise model parameters is optimized to maximize the likelihood of the noisy model, and a practical implementation is proposed based on a recursive expectation maximization (EM) framework.

Figure 5:
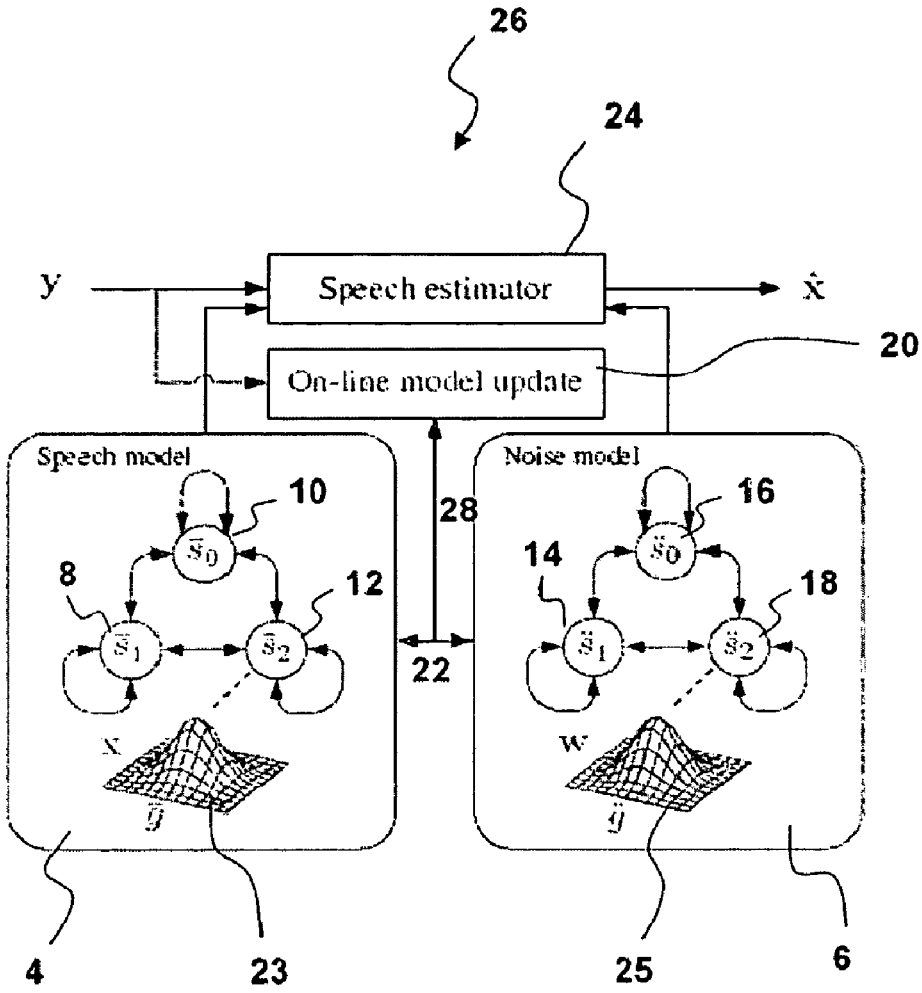
FIG. 5 shows a schematic diagram of a speech enhancement system according to another embodiment.

The estimated noise model is preferably applied to a speech enhancement system 26 with the general structure shown in FIG. 5. The general structure of the speech enhancement system 26 is the same as that of the system 2 shown in FIG. 1, apart from the arrow 28, which indicates that information about the models 4, and 6 is used in the dynamical updating module 20.

In the following is present a novel and inventive noise estimation algorithm according to the inventive method based on SG-HMM modeling of speech and noise. The signal model is presented in section 2A, and the dynamical model-parameter estimation of the noise model in section 2B. A safety-net strategy for improving the robustness of the method is presented in section 2C.

2A. Signal Model

In analogy with the above mentioned signal model described in section 1, we consider the enhancement of speech contaminated by independent additive noise. The signal is processed in blocks of K samples, preferably of a length of 20-32 ms, within which a certain stationarity of the speech and noise may be assumed. The n'th noisy speech signal block is, as before, modeled as in section 1 and the speech model is, preferably as described in section 1A.

The statistics of noise is modeled using a stochastic-gain HMM (SG-HMM) with explicit gain models in each state. Let $w_0^n=\{w_0, \ldots, w_n\}$ denote a sequence of the noise block realizations from 0 to n, the probability density function (PDF) of $w_0^n$ is then (in analogy with section 1A) modeled as (Eq. 51):

$$f(w_0^n) = \sum_{\ddot{s}\in\ddot{S}} \prod_{t=0}^{n} \ddot{a}_{\ddot{s}t-1\ddot{s}t} f_{\ddot{s}t}(w_t),$$

where the summation is over the set of all possible state sequences $\ddot{S}$, and for each realization of the state sequence $\ddot{s}=[\ddot{s}_0, \ddot{s}_1, \ldots, \ddot{s}_{n-1}]$, where $\ddot{s}_n$ denotes the state of the n'th block $\ddot{a}_{s_{n-1}s_n}$ denotes the transition probability from state $\ddot{s}_{n-1}$ to state $\ddot{e}_n$, and $f_{s_n}(w_n)$ denotes the state dependent probability of $w_n$ at state $\ddot{s}_n$. In the following the notation $f(w_n)$ is used instead of $f(W=w_n)$ for simplicity, and the time index n is sometimes neglected when the time information is clear from the context.

The state-dependent PDF incorporates explicit gain models. Let $\ddot{g}'_n=\log \ddot{g}_n$ denotes the noise gain in the logarithmic domain. The state-dependent PDF of the noise SG-HMM is defined by the integral over the noise gain variable in the logarithmic domain and we get as before (Eq. 52-53):

$$f_{\ddot{s}}(w_n) = \int_{-\infty}^{\infty} f_{\ddot{s}}(\ddot{g}'_n) f_{\ddot{s}}(w_n|\ddot{g}'_n) d\ddot{g}'_n,$$

$$f_{\ddot{s}}(\ddot{g}'_n) = \frac{1}{\sqrt{2\pi\ddot{\psi}_{\ddot{s}}^2}} \exp\left(-\frac{1}{2\ddot{\psi}_{\ddot{s}}^2}(\ddot{g}'_n - \ddot{\phi}_{\ddot{s}})^2\right),$$

The output model becomes in a similar way (Eq. 54):

$$f_{\ddot{s}}(w_n|\ddot{g}'_n) = \frac{1}{(2\pi\ddot{g}_n)^{\frac{K}{2}} |\ddot{D}_{\ddot{s}}|^{\frac{1}{2}}} \exp\left(-\frac{1}{2\ddot{g}_n} w_n^* \ddot{D}_{\ddot{s}}^{-1} w_n\right),$$

where $|\bullet|$ denotes the determinant, * denotes the Hermitian transpose and the covariance matrix $\ddot{D}_s=(A^*_{sAs})^{-1}$, where $A_s$ is a K times K lower triangular Toeplitz matrix with the first $\ddot{p}+1$ elements of the first column consisting of the AR coefficients $[\ddot{\alpha}_s[0], \ddot{\alpha}_s[1], \ldots \ddot{\alpha}_s[\ddot{p}]]^T$ for $\ddot{\alpha}_s[0]=1$. In this model, the noise gain $\ddot{g}_n$ is considered as a non-stationary stochastic process.

For a given noise gain $\ddot{g}_n$, the PDF $f_s(w_n|\ddot{g}'_n)$ is considered to be a $\ddot{p}$–th order zero-mean Gaussian AR density function, equivalent to white Gaussian noise filtered by an all-pole AR model filter.

Under the assumption of large K, it can be shown, that the density function is approximately given by (Eq. 55)

$$f_{\ddot{s}}(w_n|\ddot{g}_n) \approx (2\pi\ddot{g}_n)^{-K/2}\exp\left(-\frac{1}{2\ddot{g}_n}\sum_{i=0}^{p} C_r(i)\ddot{r}_{\ddot{s}}[i]r_w[i]\right),$$

Where $C_r=1$ for i=0, $C_r(i)=2$ for i>0 and (Eq. 56-57):

$$\ddot{r}_{\ddot{s}}[i] = \sum_{j=0}^{p-i} \ddot{\alpha}_{\ddot{s}}[j]\ddot{\alpha}_{\ddot{s}}[j+i]$$

$$r_w[i] = \sum_{j=0}^{K-i-1} w_n[j]w_n[j+i].$$

2B. Dynamical Parameter Estimation

The noise model parameters to be estimated are $\theta=\{\ddot{a}_{s,s}, \ddot{\phi}_s, \ddot{\psi}_s^2, \ddot{\alpha}_s[i]\}$, which are the transition probabilities, means and variances of the logarithmic noise gain, and auto-regressive model parameters. The initial states are assumed to be uniformly distributed. Let s denote a composite state of the noisy HMM, consisting of combination of the state $\bar{s}$ of the speech model component and the state $\ddot{s}$ of the noise model component, the summation over a function of the composite state corresponds to summation over both the speech and noise states, e.g., $$\sum_s f(s) = \sum_{\bar{s}}\sum_{\ddot{s}} f(\bar{s}, \ddot{s}).$$

Let $z_n=\{s_n, \ddot{g}_n, \bar{g}_n, x_n\}$ denote the hidden variables at block n. The dynamical estimation of the noise model parameters can be formulated using the recursive EM algorithm (Eq. 58):

$$\hat{\theta}_n = \underset{\theta}{\operatorname{argmax}} Q_n(\theta|\hat{\theta}_0^{n-1}),$$

where $\hat{\theta}_0^{n-1}=\{\hat{\theta}_j\}_{j=0\ldots n-1}$ denotes the estimated parameters from the first block to the (n−1)'th block and the auxiliary function $Q_n(\bullet)$ is defined as (Eq. 59):

$$Q_n(\theta/\mathbf{51}\ \hat{\theta}_0^{n-1})=\int_{z_0^n} f(z_0^n|y_0^n, \hat{\theta}_0^{n-1})\log f(z_0^n, y_0^n|\theta)\, dz_0^n$$

The integral of (Eq. 59) over all possible sequences of the hidden variables can be solved by looking at each time index t and integrate over each hidden variable. By further applying the conditional independency property of HMM, the $Q_n(\bullet)$ function can be rewritten as (Eq. 60):

$$Q_n(\theta|\hat{\theta}_0^{n-1}) \sim \sum_{t=0}^{n}\left[\sum_{s_t}\int\int\int f(s_t, \ddot{g}_t, \bar{g}_t, x_t|y_0^n, \hat{\theta}_0^{n-1})(\log f_{s_t}(y_t|\ddot{g}_t, \bar{g}_t, x_t, \theta) + \log f_{\ddot{s}_t}(\ddot{g}_t|\theta))d\ddot{g}_t d\bar{g}_t dx_t + \sum_{s_{t-1}}\sum_{s_t}\int\int f(s_{t-1}, s_t, \ddot{g}_t, \bar{g}_t|y_0^n, \hat{\theta}_0^{n-1})\log \ddot{a}_{\ddot{s}_{t-1}\ddot{s}_t} d\ddot{g}_t d\bar{g}_t\right],$$

where the irrelevant terms with respect to θ have been neglected.

We apply the so called fixed-lag estimation approach to $f(s_t, \ddot{g}_t, \bar{g}_t, x_t|y_0^n, \hat{\theta}_0^{n-1})$ in order to facilitate low complexity and low memory implementation. We approximate (Eq. 61):

$$f(s_t, \ddot{g}_t, \bar{g}_t, x_t|y_0^n, \hat{\theta}_0^{n-1}) \approx f(s_t, \ddot{g}_t, \bar{g}_t, x_t|y_0^t, \hat{\theta}_0^{t-1})$$

$$\gamma_t(s_t) f_{s_t}(\ddot{g}_t, \bar{g}_t, y_t|y_0^{t-1}, \hat{\theta}_0^{t-1}) = \frac{f_{s_t}(x_t|\ddot{g}_t, \bar{g}_t, y_0^t, \hat{\theta}_0^{t-1})}{f(y_t|y_0^{t-1}, \theta_0^{t-1})}$$

$$\gamma_t(s_t) f_{s_t}(\ddot{g}_t, \bar{g}_t, y_t|\hat{\theta}_{t-1}) = \frac{f_{s_t}(x_t|\ddot{g}_t, \bar{g}_t, y_t, \hat{\theta}_{t-1})}{f(y_t|y_0^{t-1}, \hat{\theta}_0^{t-1})},$$

where the last step again is due to the conditional independence of HMM, and $\gamma_t(s_t)$ is the probability of being in the composite state $s_t$ given all past noisy observations up to block t−1, i.e. (Eq. 62):

$$\gamma_t(s_t) = f(s_t|y_0^{t-1}, \hat{\theta}_0^{t-1}) \sum_{s_{t-1}} f(s_{t-1}|y_0^{t-1}, \hat{\theta}_0^{t-1}) f(s_t|s_{t-1}, \hat{\theta}_{t-1}),$$

In which $f(s_{t-1}|y_0^{t-1}, \hat{\theta}_0^{n-1})$ is the forward probability at block t−1, obtained using the forward algorithm. Similarly we have (Eq. 63):

$$f(s_{t-1}, s_t, \ddot{g}_t, \bar{g}_t|y_0^n, \hat{\theta}_0^{n-1}) \approx f(s_{t-1}, s_t, \ddot{g}_t, \bar{g}_t|y_0^t, \hat{\theta}_0^{t-1}) = \frac{f(s_{t-1}|y_0^{t-1}, \hat{\theta}_0^{t-1}) f(s_t|s_{t-1}, \hat{\theta}_{t-1}) f_{s_t}(\ddot{g}_t, \bar{g}_t, y_t|\hat{\theta}_{t-1})}{f(y_t|y_0^{t-1}, \hat{\theta}_0^{t-1})}$$

Again it seems practical to use the Dirac delta function approximation (Eq. 64):

(Eq. 65):

$$f_{s_t}(\ddot{g}_t, \bar{g}_t, y_t) \approx f_{s_t}(\ddot{g}_t, \bar{g}_t, y_t)\delta(\ddot{g}_t - \hat{\ddot{g}}_{s_t})\delta(\bar{g}_t - \hat{\bar{g}}_{s_t}),$$

and $$\{\hat{\bar{g}}_{s_t}, \hat{\ddot{g}}_{s_t}\} = \underset{\bar{g}_t, \ddot{g}_t}{\operatorname{argmax}} \log f_{s_t}(\ddot{g}_t, \bar{g}_t, y_t).$$

Now applying the approximations (eq. 61, 63 and 64), the function $Q_n(\bullet)$ given by (Eq. 59) may be further simplified to (Eq. 66):

(Eq. 67):

$$Q_n(\theta|\hat{\theta}_0^{n-1}) \sim \sum_{t=0}^{n} \mathcal{L}_t(\theta|\hat{\theta}_0^{t-1})$$

Where $$\mathcal{L}_t(\theta|\hat{\theta}_0^{t-1}) = \sum_s \frac{\omega_t(s)}{\Omega_t} \int f_s(x_t \mid \hat{\ddot{g}}_{s_t}, \hat{\ddot{g}}_{s_t}, y_t, \hat{\theta}_{t-1}) \log f_s(y_t|\hat{\ddot{g}}_{s_t}, \hat{\ddot{g}}_{s_t}, x_t, \theta) dx_t + \sum_{s'} \sum_s \frac{\omega_t'(s', s)}{\Omega_t} \log \ddot{a}_{\ddot{s},\ddot{s}} + \sum_s \frac{\omega_t(s)}{\Omega_t} \log f_s(\hat{\ddot{g}}_{s_t}|\theta)$$

$$= \mathcal{L}_{t_1} + \mathcal{L}_{t_2} + \mathcal{L}_{t_3},$$

and (Eq. 68):

$$\omega_t(s_t) = \gamma_t(s_t) f_{s_t}(\hat{\ddot{g}}_{s_t}, \hat{\ddot{g}}_{s_t}, y_t|\hat{\theta}_{t-1})$$

and (Eq. 69):

$$\omega_t'(s_{t-1}, s_t) = f(s_{t-1}|y_0^{t-1}, \hat{\theta}_0^{t-1}) f(s_t|s_{t-1}, \hat{\theta}_{t-1}) f_{s_t}(\hat{\ddot{g}}_{s_t}, \hat{\ddot{g}}_{st}, y_t|\hat{\theta}_{t-1})$$

and (Eq. 70):

$$\begin{aligned}\Omega_t &= f(y_t|y_0^{t-1}, \hat{\theta}_0^{t-1}) \\ &\approx \sum_{s_{t-1}} \sum_{s_t} f(s_{t-1}, s_t, \hat{\ddot{g}}_{s_t}, \hat{\ddot{g}}_{s_t}, y_t \mid y_0^{t-1}, \hat{\theta}_0^{t-1}) \\ &= \sum_s \omega_t(s) \\ &= \sum_{s'} \sum_s \omega_t'(s', s).\end{aligned}$$

By change of variable, $y_t = x_t + w_t$, and group relevant terms together, the auxiliary function with respect to the AR parameters becomes (Eq. 71):

$$\sum_{t=0}^{n} \mathcal{L}_{t_1} = \sum_{t=0}^{n} \sum_s \frac{\omega_t(s)}{\Omega_t} \int f_s(w_t|\hat{\ddot{g}}_{s_t}, \hat{\ddot{g}}_{s_t}, y_t, \hat{\theta}_{t-1}) \log f_s(w_t|\hat{\ddot{g}}_{s_t}, \theta) dw_t \sim \sum_{\ddot{s}} \sum_{i=0}^{p} C_r(i) \ddot{r}_{\ddot{s}}[i] \left( \sum_{t=0}^{n} \sum_{\ddot{s}} \frac{\omega_t(s)}{\Omega_t} \frac{\int f_s(w_t|\hat{\ddot{g}}_{s_t}, \hat{\ddot{g}}_{s_t}, y_t, \hat{\theta}_{t-1}) r_w[i] dw_t}{\hat{\ddot{g}}_{s_t}} \right).$$

To solve the optimal noise AR parameters for state $\ddot{s}$ at block n, we first estimate the autocorrelation sequence, which can be formulated as a recursive algorithm (Eq. 72):

$$\hat{\ddot{r}}_{\ddot{s}}[i]_n = \frac{\left( \sum_{t=0}^{n} \sum_s \frac{\omega_t(s)}{\Omega_t} \frac{\int f_s(w_t \mid \hat{\ddot{g}}_{s_t}, \hat{\ddot{g}}_{s_t}, y_t, \hat{\theta}_{t-1}) r_w[i] dw_t}{\hat{\ddot{g}}_{s_t}} \right)}{\left( \sum_{t=0}^{n} \sum_{\ddot{s}} \frac{\omega_t(s)}{\Omega_t} \right)} = \hat{\ddot{r}}_{\ddot{s}}[i]_{n-1} + \frac{1}{\Xi_n(\ddot{s})} \sum_s \frac{w_n(s)}{\Omega_n} \cdot \left( \frac{\int f_s(w_n \mid \hat{\ddot{g}}_{s_n}, \hat{\ddot{g}}_{s_n}, y_n, \hat{\theta}_{n-1}) r_w[i] dw_n}{\hat{\ddot{g}}_{s_n}} - \ddot{r}_{\ddot{s}}[i]_{n-1} \right).$$

Where (Eq. 73):

$$\Xi_n(\ddot{s}) = \sum_{t=0}^{n} \sum_{\ddot{s}} \frac{\omega_t(s)}{\Omega_t} = \Xi_{n-1}(\ddot{s}) + \sum_{\ddot{s}} \frac{\omega_n(s)}{\Omega_n}.$$

The expected value $$\int f_s(w_n \mid \hat{\ddot{g}}_{s_n}, \hat{\ddot{g}}_{s_n}, y_n, \hat{\theta}_{n-1}) r_w[i] dw_n$$

can be solved by applying the inverse Fourier transform of the expected noise sample spectrum. The AR parameters are then obtained from the estimated autocorrelation sequence using the so called Levinson-Durbin recursive algorithm as described in Bunch, J. R. (1985). "Stability of methods for solving Toeplitz systems of equations." SIAM J. Sci. Stat. Comput., v. 6, pp. 349-364, which is hereby incorporated by reference in its entirety.

The optimal state transition probability $\ddot{a}_{s',s}$ with respect to the auxiliary function (Eq. 67) can be solved under the constraint $$\sum_{\ddot{s}} \ddot{a}_{\ddot{s}\ddot{s}} = 1.$$

Let $$\tau_t(\ddot{s}', \ddot{s}) = \sum_{\ddot{s}} \sum_{\ddot{s}'} \frac{\omega_t'(s', s)}{\Omega_t},$$

the solution can be formulated recursively (Eq. 74):

$$\hat{\ddot{a}}_{\ddot{s}\ddot{s},n} = \hat{\ddot{a}}_{\ddot{s}\ddot{s},n-1} + \frac{\sum_{\ddot{s}} \tau_n(\ddot{s}', \ddot{s})}{\Xi_n'(\ddot{s}')} \left( \frac{\tau_n(\ddot{s}', \ddot{s})}{\sum_{\ddot{s}} \tau_n(\ddot{s}', \ddot{s})} - \hat{\ddot{a}}_{\ddot{s}\ddot{s},n-1} \right).$$

where (Eq. 75):

$$\Xi'_n(\ddot{s}') = \Xi'_{n-1}(\ddot{s}') + \sum_{\ddot{s}} \tau_n(\ddot{s}', \ddot{s}).$$

The remainder of the noise model parameters may also be estimated using recursive estimation algorithms. The update equations for the gain model parameters may be shown to be (Eq. 76):

$$\hat{\hat{\phi}}_{\ddot{s},n} = \hat{\hat{\phi}}_{\ddot{s},n-1} + \frac{1}{\Xi_n(\ddot{s})} \sum_{s} \frac{\omega_n(s)}{\Omega_n} \left( \hat{\hat{g}}'_{s_n} - \hat{\hat{\phi}}_{\ddot{s},n-1} \right),$$

and (*Eq.* 77):

$$\hat{\hat{\psi}}^2_{\ddot{s},n} = \hat{\hat{\psi}}^2_{\ddot{s},n-1} + \frac{1}{\Xi_n(\ddot{s})} \sum_{s} \frac{\omega_n(s)}{\Omega_n} \cdot \left( \left( \hat{\hat{g}}'_{s_n} - \hat{\hat{\phi}}'_{\ddot{s},n-1} \right)^2 - \hat{\hat{\psi}}^2_{\ddot{s},n-1} \right).$$

In order to estimate time-varying parameters of the noise model, forgetting factors may be introduced in the update equations to restrict the impact of the past observations. Hence, the modified normalization terms are evaluated by recursive summation of the past values (Eq. 78 and 79):

$$\Xi_n(\ddot{s}) = \rho \Xi_{n-1}(\ddot{s}) + \sum_{s} \frac{\omega_n(s)}{\Omega}.$$

$$\Xi'_n(\ddot{s}') = \rho \Xi'_{n-1}(\ddot{s}') + \sum_{\ddot{s}} \tau_n(\ddot{s}', \ddot{s}),$$

where $0 \leqq \rho \leqq 1$ is an exponential forgetting factor and $\rho=1$ corresponds to no forgetting.

2C. Safety-net State Strategy

The recursive EM based algorithm using forgetting factors may be adaptive to dynamic environments with slowly-varying model parameters (as for the state dependent gain models, the means and variances are considered slowly-varying). Therefore, the method may react too slowly when the noisy environment switches rapidly, e.g., from one noise type to another. The issue can be considered as the problem of poor model initialization (when the noise statistics changes rapidly), and the behavior is consistent with the well-known sensitivity of the Baum-Welch algorithm to the model initialization (the Baum-Welch algorithm can be derived using the EM framework as well). To improve the robustness of the method, a safety-net state is introduced to the noise model. The process can be considered as a dynamical model re-initialization through a safety-net state, containing the estimated noise model from a traditional noise estimation algorithm.

The safety-net state may be constructed as follows. First select a random state as the initial safety-net state. For each block, estimate the noise power spectrum using a traditional algorithm, e.g. a method based on minimum statistics. The noise model of the safety-net state may then be constructed from the estimated noise spectrum, where the noise gain variance is set to a small constant. Consequently, the noise model update procedure in section 2B is not applied to this state. The location of the safety-net state may be selected once every few seconds and the noise state that is least likely over this period will become the new safety-net state. When a new location is selected for the safety net state (since this state is less likely than the current safety net state), the current safety net state will become adaptive and is initialized using the safety-net model.

The proposed noise estimation algorithm is seen to be effective in modeling of the noise gain and shape model using SG-HMM, and the continuous estimation of the model parameters without requiring VAD, that is used in prior art methods. As the model is parameterized per state, it is capable of dealing with non-stationary noise with rapidly changing spectral contents within a noisy environment. The noise gain models the time-varying noise energy level due to, e.g., movement of the noise source. The separation of the noise gain and shape modeling allows for improved modeling efficiency over prior art methods, i.e. the noise model according to the inventive method would require fewer mixture components and we may assume that model parameters change less frequently with time. Further, the noise model update is performed using the recursive EM framework, hence no additional delay is required.

2D. Evaluation of the Safety-net Strategy

The system is implemented as shown in FIG. 5 and evaluated for 8 kHz sampled speech. The speech HMM consists of eight states and 16 mixture components per state. The AR model of order 10 is used. The training of the speech HMM is performed using 640 utterances from the training set of the TIMIT database. The noise model uses AR order six, and the forgetting factor ρ is experimentally set to 0.95. To avoid vanishing support of the gain models, we enforce a minimum allowed variance of the gain models to be 0.01, which is the estimated gain variance for white Gaussian noise. The system operates in the frequency domain in blocks of 32 ms windows using the Hanning (von Hann) window. The synthesis is performed using 50% overlap-and-add. The noise models are initialized using the first few signal blocks which are considered to be noise-only.

The safety-net state strategy can be interpreted as dynamical re-initialization of the least probably noise model state. This approach facilitates an improved robustness of the method for the cases when the noise statistics changes rapidly and the noise model is not initialized accordingly. In this experimental evaluation of the safety-net strategy, the safety-net state strategy is evaluated for two test scenarios. Both scenarios consist of two artificial noises generated using the white Gaussian noise filtered by FIR filters, one low-pass filter with coefficients [0.5 0.5] and one high-pass filter with coefficients [0.5-0.5]. The two noise sources are alternated every 500 ms (scenario one) and 5 s (scenario two).

The objective measure for the evaluation is (as before) the log-likelihood (LL) score of the estimated noise models using the true noise signals. In analogy with (Eq. 50), we have for the n'th block (Eq. 80):

$$LL(w_n) = \log\left( \frac{1}{\Omega_n} \sum_{s} \omega_n(s) \hat{f}_s(w_n) \right),$$

where $$\hat{f}_s(w_n) = f_{\ddot{s}}(w_n | \hat{\hat{g}}_n)$$

is the density function (Eq. 54) evaluated using the estimated noise gain $$\hat{\hat{g}}_n.$$

Figure 6:
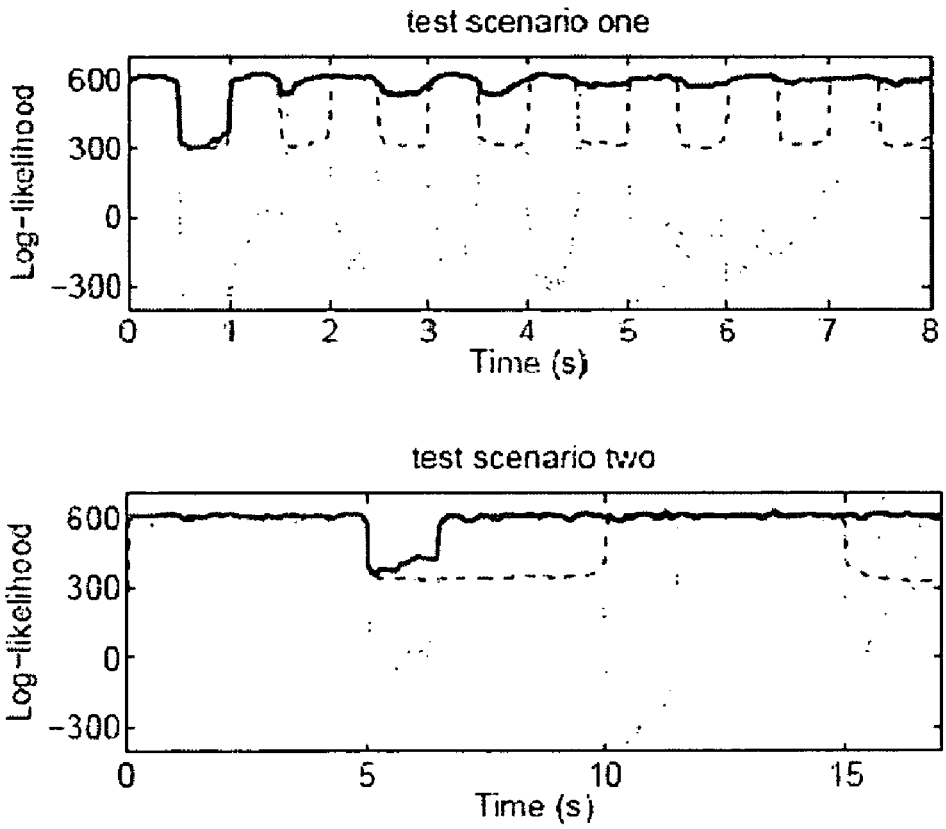
FIG. 6 shows a log likelihood (LL) evaluation of the safety-net strategy.

This embodiment of the inventive method is tested with and without the safety-net state using a noise model of three states. For comparison, the noise model estimated from the minimum statistics noise estimation method is also evaluated as the reference method. The evaluated LL scores for one particular realization (four utterances from the TIMIT database) of 5 dB SNR are shown in FIG. 6, where the LL of the estimated noise models versus number of noise model states is shown. The solid lines are from the inventive method, dashed lines and dotted lines are from the prior art methods.

For the test scenario one (upper plot of FIG. 6), the reference method does not handle the non-stationary noise statistics and performs poorly. The method without the safety-net state performs well for one noise source, and poorly for the other one, most likely due to initialization of the noise model. The method with safety-net state performs consistently better than the reference method because that the safety net state is constructed using a additional stochastic gain model. The reference method is used to obtain the AR parameters and mean value of the gain model. The variance of the gain is set to a small constant. Due to the re-initialization through the safety-net state, the method performs well on both noise sources after an initialization period.

For the test scenario two (lower plot of FIG. 6), due to the stationarity of each individual noise source, the reference method performs well about 1.5 s after the noise source switches. This delay is inherent due to the buffer length of the method. The method without the safety-net state performs similarly as in scenario one, as expected. The method with the safety-net state suffers from the drop of log-likelihood score at the first noise source switch (at the fifth second). However, through the re-initialization using the safety-net state, the noise model is recovered after a short delay. It is worth noting that the method is inherently capable of learning such a dynamic noise environment through multiple noise states and stochastic gain models, and the safety-net state approach facilitates robust model re-initialization and helps preventing convergence towards an incorrect and locally optimal noise model.

Parameterization by Spectral Coefficients

Figure 7:
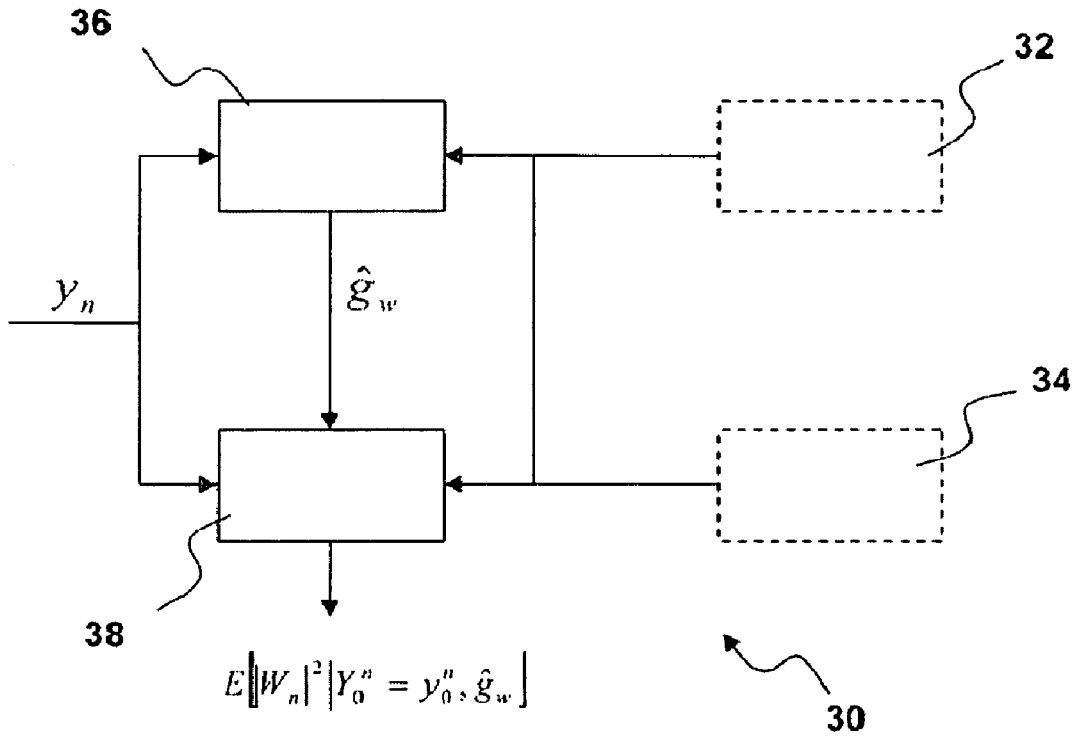
FIG. 7 shows a schematic diagram of a noise gain estimation system.

In FIG. 7 is shown a general structure of a system 30 that is adapted to execute a noise estimation algorithm according to one embodiment of the inventive method. The system 30 in FIG. 7 comprises a speech model 32 and a noise model 34, which in one embodiment may be some kind of initially trained generic models or in an alternative embodiment the models 32 and 34 are modified in compliance with the noisy environment. The system 30 furthermore comprises a noise gain estimator 36 and a noise power spectrum estimator 38. In the noise gain estimator 36 the noise gain in the received noisy speech $y_n$ is estimated on the basis of the received noisy speech $y_n$ and the speech model 32. Alternatively, the noise gain in the received noisy speech $y_n$ is estimated on the basis of the received noisy speech $y_n$, the speech model 32 and the noise model 34. This noise gain estimate $\hat{g}_w$ is used in the noise power spectrum estimator 38 to estimate the power spectrum of the at least one noise component in the received noisy speech $y_n$. This noise power spectrum estimate is made on the basis of the received noisy speech $y_n$, the noise gain estimate $\hat{g}_w$, and the noise model 34. Alternatively, the noise power spectrum estimate is made on the basis of the received noisy speech $y_n$, the noise gain estimate $\hat{g}_w$, the noise model 34 and the speech model 32. In the following a more detailed description of an implementation of the inventive method in the system 30 will be given.

HMM are used to describe the statistics of speech and noise. The HMM parameters may be obtained by training using the Baum-Welch algorithm and the EM algorithm. The noise HMM may initially be obtained by off-line training using recorded noise signals, where the training data correspond to-a particular physical arrangement, or alternatively by dynamical training using gain-normalized data. The estimated noise is the expected noise power spectrum given the current and past noisy spectra, and given the current estimate of the noise gain. The noise gain is in this embodiment of the inventive method estimated by maximizing the likelihood over a few noisy blocks, and is implemented using the stochastic approximation.

First, we consider the logarithm of the noise gain as a stochastic first-order Gauss-Markov process. That is, the noise gain is assumed to be log-normal distributed. The mean and variance are estimated for each signal block using the past noisy observations. The approximated PDF is then used in the novel and inventive Bayesian speech estimator given by (Eq. 16) obtained by the novel and inventive cost function given by (Eq. 17). This estimator allows for an adjustable level of residual noise. Later, a computationally simpler alternative based on the maximum likelihood (ML) criterion is derived.

3A. Signal Model

We consider a noise suppression system for independent additive noise. The noisy signal is processed on a block-by-block basis in the frequency domain using the fast Fourier transform (FFT). The frequency domain representation of the noisy signal at block n is modeled as (Eq. 81):

$$y_n = x_n + w_n,$$

where $y_n=[y_n[0], \ldots, y_n[L-1]]^T$, $x_n=[x_n[0], \ldots, x_n[L-1]]^T$ and $w_n=[w_n[0], \ldots, w_n[L-1]]^T$ are the complex spectra of noisy; clean speech and noise, respectively, for frequency channels $0 \leqq l < L$. Furthermore, we assume that the noise $w_n$ can be decomposed as $w_n=\sqrt{g_{w_n}}\ddot{w}_n$, where denotes $g_{w_n}$ the noise gain variable, and $\ddot{w}_n$ is the gain-normalized noise signal block, whose statistics is modeled using an HMM. Each output probability for a given state is modeled using a Gaussian mixture model (GMM). For the noise model, $\ddot{\pi}$ denotes the initial state probabilities, $\ddot{a}=[\ddot{a}_{st}]$ denotes the state transition probability matrix from state s to t and $\ddot{\rho}=\{\ddot{\rho}_{i|s}\}$ denotes the mixture weights for a given state s. We define the component PDF for the i'th mixture component of the state s as (Eq. 82)

$$f_{i|s}(x_n) = \prod_{k=0}^{K-1} \frac{1}{\sqrt{2\pi\ddot{\sigma}^2_{i|s}[k]}} \exp\left(-\frac{1}{2}\frac{E^2_{x_n}[k]}{\ddot{\sigma}^2_{i|s}[k]}\right),$$

where $$E^2_{x_n}[k] = \sum_{l=low(k)}^{high(k)} |x_n[l]|^2$$

is the speech energy in the sub-band $0 \leqq k < K$, and low(k) and high(k) provide the frequency boundaries of the subband. The corresponding parameters for the speech model are denoted using bar instead of double dots.

The component model can be motivated by the filter-bank point-of-view, where the signal power spectrum is estimated in subbands by a filter-bank of band-pass filters. The subband spectrum of a particular sound is assumed to be a Gaussian with zero-mean and diagonal covariance matrix. The mixture components model multiple spectra of various classes of sounds. This method has the advantage of a reduced parameter space, which leads to lower computational and memory requirements. The structure also allows for unequal frequency bands, such that a frequency resolution consistent with the human auditory system may be used.

The HMM parameters are obtained by training using the Baum-Welch algorithm and the expectation-maximization (EM) algorithm, from clean speech and noise signals. To simplify the notation, we write $y_0^n=\{y_\tau, \tau=0, \ldots, n\}$, and f(x) instead of $f_X(X)$ in all PDFs. The dependency of the mixture component index on the state is also dropped, e.g., we write $b_i$ instead of $b_{i|s}$.

3B. Speech Estimation

In this section, we derive a speech spectrum estimator based on a criterion that leaves an adjustable level of residual noise in the enhanced speech. As before we consider the Bayesian estimator (Eq. 83):

$$\hat{x}_n = \underset{\bar{x}_n}{\operatorname{argmin}} E[C(X_n, W_n, \bar{x}_n) | Y_0^n = y_0^n],$$

Minimizing the Bayes risk for the cost function (Eq. 84):

$$C'(x_n, w_n, \bar{x}_n)=|(x_n+\epsilon w_n)-\bar{x}_n|^2.$$

Where |•| denotes a suitably chosen vector norm and $0 \leqq \epsilon < 1$ defines an adjustable level of residual noise and $\tilde{x}_n$ denotes a candidate for the estimated enhanced speech component. The cost function is the squared error for the estimated speech compared to the clean speech plus some residual noise. By explicitly leaving some level of residual noise, the criterion reduces the processing artifacts, which are commonly associated with traditional speech enhancement systems. Unlike a constrained optimization approach, which is limited to linear estimators, the hereby proposed Bayesian estimator can be nonlinear as well. The residual-noise level $\epsilon$ can be extended to be time- and frequency dependent, to introduce perceptual shaping of the noise.

To solve the speech estimator (Eq. 83), we first assume that the noise gain $g_{w_n}$ is given. The PDF of the noisy signal $f(y_n|g_{w_n})$ is an HMM composed by combining of the speech and noise models. We use $s_n$ to denote a composite state at the n'th block, which consists of the combination of a speech model state $\bar{s}_n$ and a noise model state $\ddot{s}_n$. The covariance matrix of the ij'th mixture component of the composite state $s_n$ has $\bar{c}_i^2[k]+g_{w_n}\ddot{c}_j^2[k]$ on the diagonal.

Using the Markov assumption, the posterior speech PDF given the noisy observations and noise gain is (Eq. 85):

$$f(x_n|y_0^n, g_{w_n}) = \frac{\sum_{s_n,i,j} \gamma_n \bar{p}_i \ddot{p}_j f_{ij}(y_n|g_{w_n}) f_{ij}(x_n|y_n, g_{w_n})}{f(y_n|y_0^{n-1}, g_{w_n})}$$

where $\gamma_n$ is the probability of being in the composite state $s_n$ given all past noisy observations up to block n−1, i.e. (Eq. 86):

$$\gamma_n = p(s_n|y_0^{n-1}) = \sum_{s_{n-1}} p(s_{n-1}|y_0^{n-1}) a_{s_{n-1}s_n},$$

where $p(s_{n-1}|y_0^{n-1})$ is the scaled forward probability. The posterior noise PDF $f(w_n|y_0^n, g_{w_n})$ has the same structure as (Eq. 85), with the $x_n$ replaced by $w_n$. The proposed estimator becomes (Eq. 87):

$$\hat{x}_n = \frac{\sum_{s_n,i,j} \gamma_n \bar{p}_i \ddot{p}_j f_{ij}(y_n|g_{w_n}) \mu_{ij}(g_{w_n})}{f(y_n|y_0^{n-1}, g_{w_n})},$$

Where for the i'th frequency bin (Eq. 88):

$$\mu_{ij}(g_{w_n})[l] = \frac{\bar{c}_i^2[k] + \epsilon g_{w_n} \ddot{c}_j^2[k]}{\bar{c}_i^2[k] + q_{w_n} \ddot{c}_j^2[k]} y_n[l],$$

for the subband k fulfilling low(k)≦l≦high(k). The proposed speech estimator is a weighted sum of filters, and is nonlinear due to the signal dependent weights. The individual filter (Eq. 88) differs from the Wiener filter by the additional noise term in the numerator. The amount of allowed residual noise is adjusted by $\epsilon$. When $\epsilon=0$, the filter converges to the Wiener filter. When $\epsilon=1$, the filter is one, which does not perform any noise reduction. A particularly interesting difference between the filter (Eq. 88) and the Wiener filter is that when there is no speech, the Wiener filter is zero while the filter (Eq. 88) becomes $\epsilon$. This lower bound on the noise attenuation is then used in the speech enhancement in order to for example reduce the processing artifact commonly associated with speech enhancement systems.

3C. Noise Gain Estimation

In this section two algorithms for noise and gain estimation according to the inventive method are described. First, we derive a method based on the assumption that $g_{w_n}$ is a stochastic process. Secondly, a computationally simpler method using the maximum likelihood criterion is used.

Using the given speech and noise models 32 and 34, we may estimate the expected noise power spectrum for noise gain $g_{w_n}$, and the noisy spectra $y_0^n$. The noise power spectrum estimator is a weighted sum consisting of (Eq. 89):

$$\hat{P}_{w_n} = E\lfloor |W_n|^2 | y_0^n \rfloor = \sum_{s_n,i,j} \alpha_{s_n,i,j} \mu_{ij}(g_{w_n}),$$

where $\alpha_{s_n,i,j}$ is a weighing factor depending on the likelihood for the i,j'th component and (Eq. 90):

$$\mu_{ij}(g_{w_n})[k] = \left| \frac{g_{w_n} \ddot{c}_j^2[k]}{\bar{c}_i^2[k] + g_{w_n} \ddot{c}_j^2[k]} y_n[k] \right|^2 + \frac{\bar{c}_i^2[k] g_{w_n} \ddot{c}_j^2[k]}{\bar{c}_i^2[k] + g_{w_n} \ddot{c}_j^2[k]},$$

for the I'th frequency bin.

The Stochastic Approach

In this section, we assume $g_{w_n}$ to be a stochastic process and we assume that the PDF of $g'_{w_n}=\log g_{w_n}$ given the past noisy observations is a Gaussian, $f(g'_{w_n}|y_0^{n-1}) \approx N(\phi_n, \omega_n)$. To model the time-varying noise energy level, it is assumed that $g'_{w_n}$ is a first-order Gauss-Markov process (Eq. 91):

$$g'_{w_n}=g'_{w_{n-1}}+u_n,$$

where $u_n$ is a white Gaussian process with zero mean and variance $\sigma_u^2 \cdot \sigma_u^2$ models how fast the noise gain changes. For simplicity, $\sigma_u^2$ is set to be a constant for all noise types. The posterior speech PDF can be reformulated as an integration over all possible realizations of $g'_{w_n}$, i.e. (Eq. 92):

$$f(x_n | y_0^n) = \int f(x_n | y_0^n, g'_{w_n}) f(g'_{w_n} | y_0^n) dg'_{w_n}$$
$$= \frac{1}{B} \sum_{s_n,i,j} \gamma_n \bar{p}_i \bar{p}_j \int \xi_{ij}(g'_{w_n}) f_{ij}(x_n | y_n g'_{w_n}) dg'_{w_n}$$

for $\xi_{ij}(g'_{w_n})=f_{ij}(y_n|g'_{w_n})f(g'_{w_n}|y_0^{n-1})$ and B ensures that the PDF integrates to one. The speech estimator (Eq. 87), assuming stochastic noise gain becomes (Eq. 93):

$$\hat{x}_n^A = \frac{1}{B}\sum_{s_n,i,j}\gamma_n\bar{p}_i\ddot{p}_j\int\xi_{ij}(g'_{w_n})\mu_{ij}(g'_{w_n})dg'_{w_n}.$$

The integral (Eq. 93) can be evaluated using numerical integration algorithms. It may be shown that the component likelihood function $f_{ij}(y_n|g_{w_n})$ decays rapidly from its mode. Thus, we make an approximation by applying the 2nd order Taylor expansion of log $\xi ij(g'_{w_n})$ around its mode $\hat{g}'_{w_n,ij}$=arg max $g'_{w_n}$ log $\xi_{ij}(g'_{w_n})$ which gives (Eq. 94):

(Eq. 95):

$$\log\xi_{ij}(g'_{w_n}) \approx \log\xi_{ij}(\hat{g}'_{w_n,ij}) - \frac{1}{2A_{ij}^2}(g'_{w_n} - \hat{g}'_{w_n,i,j})^2,$$

where $$A_{ij}^2 = -\left(\frac{\partial^2\log\xi_{ij}(g'_{w_n})}{\partial g'^{\,2}_{w_n}}\right)^{-1}.$$

To obtain the mode $\hat{g}'_{w_n,ij}$, we use the Newton-Raphson algorithm, initialized using the expected value $\phi_n$. As the noise gain is typically slowly varying for two consecutive blocks, the method usually converges within a few iterations.

To further simplify the evaluation of (Eq. 93), we approximate $\mu_{ij}(g'_{w_n})\approx\mu_{ij}(\hat{g}'_{w_n,ij})$ and integrate only $\xi_{ij}(g'_{w_n})$, which gives (Eq. 96):

$$\hat{x}_n^A \approx \frac{1}{B}\sum_{sn,i,j}\gamma_n\bar{p}_i\ddot{p}_jA_{ij}\xi_{ij}(\hat{g}'_{w_n,ij})\mu_{ij}(\hat{g}'_{w_n,ij}).$$

The parameters $f(g'_{w_{n+1}}|y_0^n)$ can be obtained by using Bayes rule. It can be shown that (Eq. 97):

$$f(g'_{w_n}|y_0^n) = \frac{1}{B}\sum_{s_n,i,j}\gamma_n\bar{p}_i\ddot{p}_j\xi_{ij}(g'_{w_n}),$$

and $f(g'_{w_{n+1}}|y_0^n)$ can be calculated using (Eq. 91). To reduce the computational problem (Eq. 97) is approximated with a Gaussian, thus requiring only first order statistics. The parameters of $f(g'_{w_{n+1}}|y_0^n)\approx N(\phi_{n+1}, \psi_{n+1})$ are obtained by (Eq. 98):

(Eq. 99):

$$\hat{\phi}_{n+1} \approx \frac{1}{B}\sum_{s_n,i,j}\gamma_n\bar{p}_i\ddot{p}_jA_{ij}\xi_{ij}(\hat{g}'_{w_n,ij})\hat{g}'_{w_n,ij}$$

and $$\hat{\psi}_{n+1} \approx \sigma_u^2 + \frac{1}{B}\sum_{s_n,i,j}\gamma_n\bar{p}_i\ddot{p}_jA_{ij}\xi_{ij}(\hat{g}'_{w_n,ij})\cdot\left(A_{ij}^2 + \left(\hat{g}'_{w_n,ij} - \hat{\phi}_{n+1}\right)^2\right).$$

To summarize, the method approximates the noise gain PDF using the log-normal distribution. The PDF parameters are estimated on a block-by-block basis using (Eq. 98) and (Eq. 99). Using the noise gain PDF, the Bayesian speech estimator (Eq. 83) can be evaluated using (Eq. 96). We refer to this method as system 3A in the experiments described in section 3D below.

Maximum Likelihood Approach

In this section, is presented a computationally simpler noise gain estimation method based on a maximum likelihood (ML) estimation technique, which method advantageously may be used in a noise gain estimator 36, shown in FIG. 7. In order to reduce the estimation variance, it is assumed that the noise energy level is relatively constant over a longer period, such that we can utilize multiple noisy blocks for the noise gain estimation. The ML noise gain estimator is then defined as (Eq. 100):

$$\hat{g}_{w_n} = \underset{g_{w_n}}{\operatorname{argmax}}\sum_{m=n-M}^{n+M}\log f(y_m|y_0^{m-1}, g_{w_n}),$$

where the optimization is over 2M+1 blocks. The log-likelihood function of the n'th block is given by (Eq. 101):

$$\log f(y_n|y_0^{n-1}, g_{w_n}) = \log\frac{1}{B}\sum_{s_n,i,j}\gamma_n\bar{p}_i\ddot{p}_jf_{ij}(y_n|g_{w_n})$$

$$\approx \log\left(\max_{s_n,i,j}\frac{\gamma_n\bar{p}_i\ddot{p}_j}{B}f_{ij}(y_n|g_{w_n})\right),$$

where the log-of-a-sum is approximated using the logarithm of the largest term in the summation. The optimization problem can be solved numerically, and we propose a solution based on stochastic approximation. The stochastic approximation approach can be implemented without any additional delay. Moreover, it has a reduced computational complexity, as the gradient function is evaluated only once for each block. To ensure $\hat{g}_{w_n}$ to be nonnegative, and to account for the human perception of loudness which is approximately logarithmic, the gradient steps are evaluated in the log domain. The noise gain estimate $\hat{g}_{w_n}$ is adapted once per block (Eq. 102):

$$\hat{g}'_{w_n} \approx \hat{g}'_{w_{n-1}} + \Delta[n]\frac{\partial\log f_{ij_{m,n}}(y_n|g_{w_n})}{\partial g'_{w_n}}$$

and (Eq. 103):

$$\hat{g}_{w_n}=\exp\hat{g}'_{w_n},$$

where $ij_{max}$ in (Eq. 102) is the index of the most likely mixture component, evaluated using the previous estimate $\hat{g}_{w_{n-1}}$. The step-size $\Delta[n]$ controls the rate of the noise gain adaptation, and is set to a constant $\Delta$. The speech spectrum estimator (Eq. 87) can then be evaluated for $g_{w_n}=\hat{g}_{w_n}$. This method is referred to as system 3B in the experiments described in section 3D below.

3D. Experiments and Results

Systems 3A and 3B are in this experimental set-up implemented for 8 kHz sampled speech. The FFT based analysis and synthesis follow the structure of the so called EVRC-NS system. In the experiments, the step size $\Delta$ is set to 0.015 and the noise variance $\sigma_u^2$ in the stochastic gain model is set to 0.001. The parameters are set experimentally to allow a relatively large change of the noise gain, and at the same time to be reasonably stable when the noise gain is constant. As the gain adaptation is performed in the log domain, the parameters are not sensitive to the absolute noise energy level. The residual noise level $\epsilon$ is set to 0.1.

The training data of the speech model consists of 128 clean utterances from the training set of the TIMIT database down-sampled to 8 kHz, with 50% female and 50% male speakers. The sentences are normalized on a per utterance basis. The speech HMM has 16 states and 8 mixture components in each state. We considered three different noisy environments in the evaluation: traffic noise, which was recorded on the side of a busy freeway, white Gaussian noise, and the babble noise from the Noisex-92 database. One minute of the recorded noise signal of each type was used in the training. Each noise model contains 3 states and 3 mixture components per state. The training data are energy normalized in blocks of 200 ms with 50% overlap to remove the long-term energy information. The noise signals used in the training were not used in the evaluation.

In the enhancement, we assume prior knowledge on the type of the noise environment, such that the correct noise model is used. We use one additional noise signal, white-2, which is created artificially by modulating the amplitude of a white noise signal using a sinusoid function. The amplitude modulation simulates the change of noise energy level, and the sinusoid function models that the noise source periodically passes by the microphone. In the experiments, the sinusoid has a period of two seconds, and the maximum amplitude modulation is four times higher then the minimum one.

Figure 8:
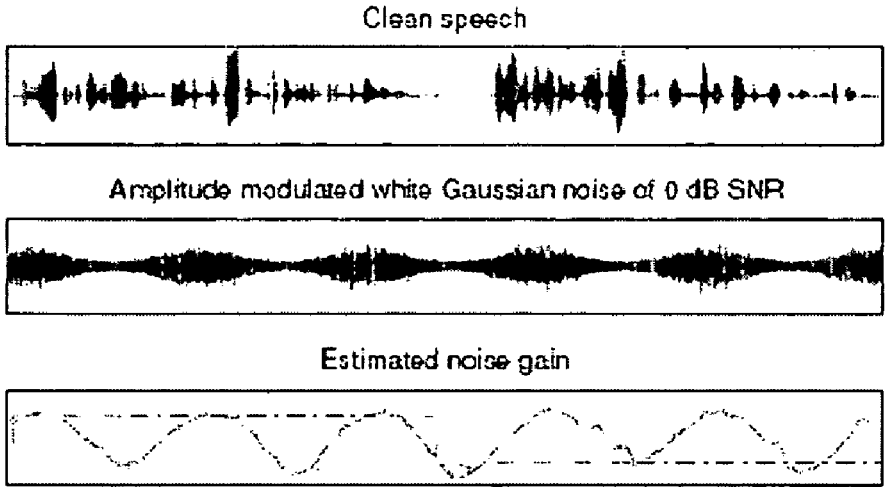
FIG. 8 shows the performance of two implementations of the noise gain estimation system in FIG. 7 as compared to state of the art prior art systems.

For comparison, we implemented two reference systems. Reference method 3C applies noise gain adaptation during detected speech pauses as described in H. Sameti et al., "HMM-based strategies for enhancement of speech signals embedded in nonstationary noise", *IEEE Trans. Speech and Audio Processing*, vol. 6, no 5, pp. 445-455", September 1998. Only speech pauses longer than 100 ms are used to avoid confusion with low energy speech. An ideal speech pause detector using the clean signal is used in the implementation of the reference method, which gives the reference method an advantage. To keep the comparison fair, the same speech and noise models as the proposed methods are used in reference 3C. Reference 3D is a spectral subtraction method described in S. Boll, "Suppression of acoustic noise in speech using spectral substraction", *IEEE Trans. Acoust, Speech, Signal Processing*, vol. 2, no. 2, pp. 113-120, April 1979, without using any prior speech or noise models. The noise power spectrum estimate is obtained using the minimum statistics algorithm from R. Martin, "Noise power spectral density estimation based on optimal smoothing and minimum statistics", *IEEE Trans. Speech and Audio Processing*, vol. 9, no. 5, pp. 504-512, July 2001. The residual noise levels of the reference systems are set to $\epsilon$. FIG. 8 demonstrates one typical realization of different noise gain estimation strategies for the white-2 noise. The solid line is the expected gain of system 3A, and the dashed line is the estimated gain of system 3B. Reference system 3C (dash-doted) updates the noise gain only during longer speech pauses, and is not capable of reacting to noise energy changes during speech activity. For reference system 3D, energy of the estimated noise is plotted (dotted). The minimum statistics method has an inherent delay of at least one buffer length, which is clearly visible from FIG. 8. Both the proposed methods 3A (solid) and 3B (dashed) are capable of following the noise energy changes, which is a significant advantage over the reference systems.

We have in this section described two related methods to estimate the noise gain for HMM-based speech enhancement. It is seen that proposed methods allow faster adaptation to noise energy changes and are, thus, more suitable for suppression of non-stationary noises. The performance of the method 3A, based on a stochastic model, is better than the method 3B, based on the maximum likelihood criterion. However, method 3B requires lesser computations, and is more suitable for real-time implementations. Furthermore, it is understood that the gain estimation algorithms (3A and 3B) can be extended to adapt the speech model as well.

Figure 9:
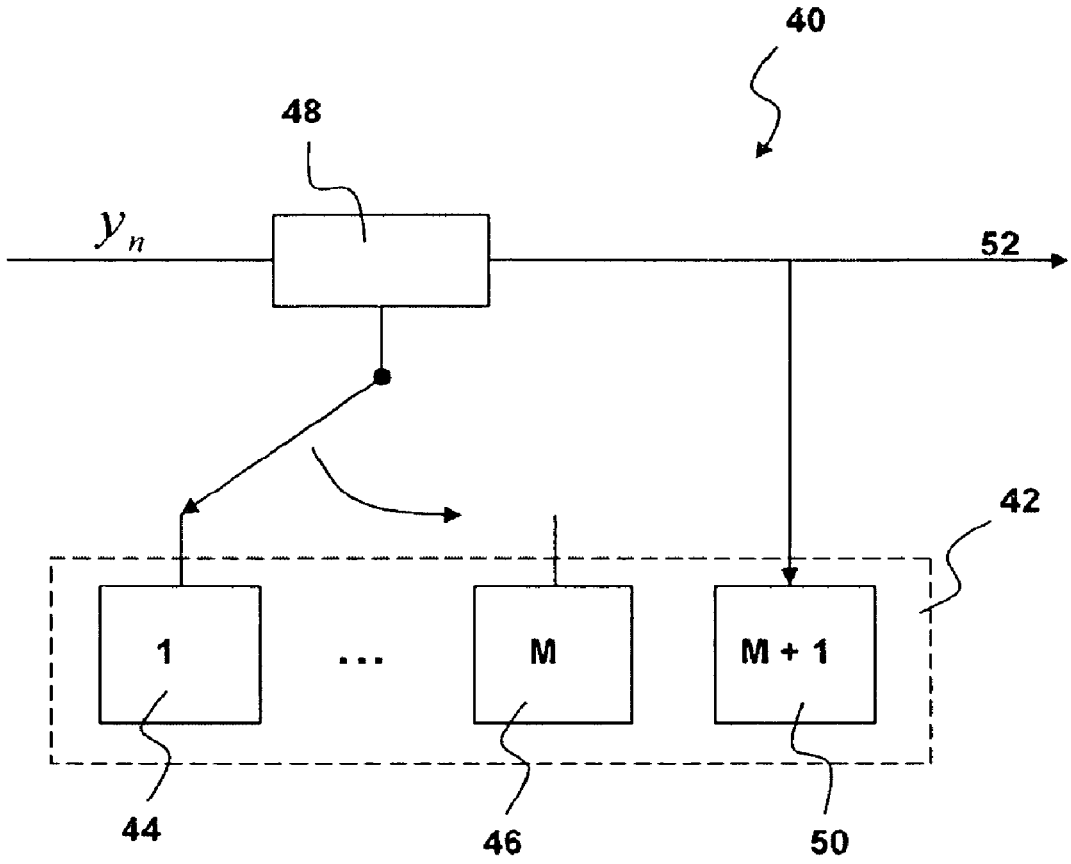
FIG. 9 shows a schematic diagram of a method of maintaining a list of noise models.

FIG. 9 shows a schematic diagram 40 of a method of maintaining a list 42 of noise models 44, 46. The list 42 of noise models 44, 46 comprises initially at least one noise model, but preferably the list 42 comprises initially M noise models, wherein M is a suitably chosen natural number greater than 1.

Throughout the present specification the wording list of noise models is sometimes referred to as a dictionary or repository, and the method of maintaining a list of noise model is sometimes referred to as dictionary extension.

Based on the reception of noisy speech $y_n$, selection of one of the M noise models from the list 42 is performed by the selection and comparison module 48. In the selection and comparison module 48 the one of the M noise models that best models the noise in the received noisy speech is chosen from the list 42. The chosen noise model is then modified, possibly online, so that it adapts to the current noise type that is embedded in the received noisy speech $y_n$. The modified noise model is then compared to the at least one noise model in the list 42. Based on this comparison that is performed in the selection and comparison module 48, this modified noise model 50 is added to the list 42. In order to avoid an endless extension of the list 42 of noise models, the modified noise model is added to the list 42 only of the comparison of the modified noise model and the at least one model in the list 42 shows that the difference of the modified noise model and the at least one noise model in the list 42 is greater than a threshold. The at least one noise models are preferably HMMs, and the selection of one of the at least one, or preferably M noise models from the list 42 is performed on the basis of an evaluation of which of the at least one models in the list 42 is most likely to have generated the noise that is embedded in the received noisy speech $y_n$. The arrow 52 indicates that the modified noise model may be adapted to be used in a speech enhancement system, whereby it is furthermore indicated that the method of maintaining a list 42 of noise models according to the description above, may in an embodiment be forming part of an embodiment of a method of speech enhancement.

Figure 10:
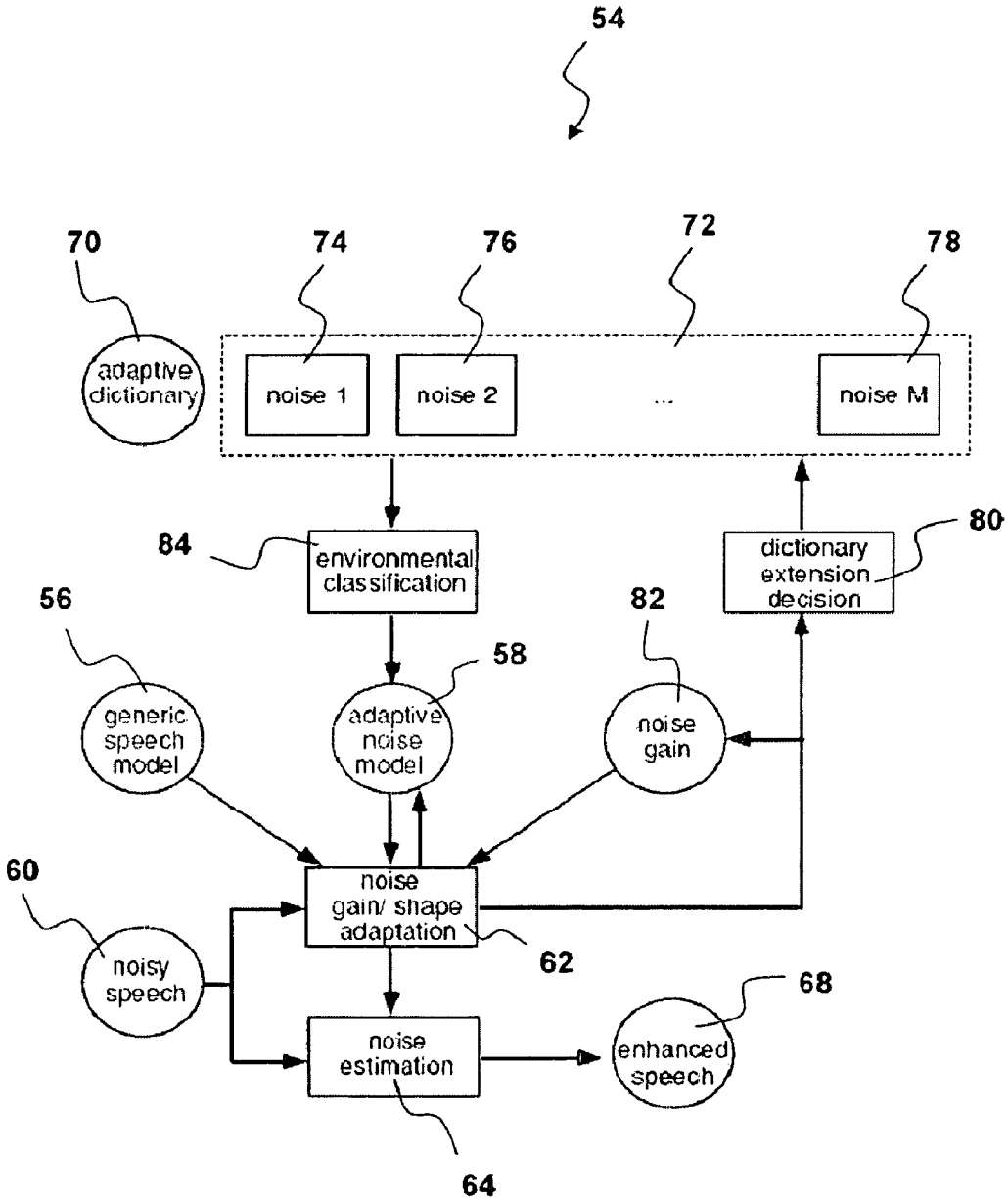
FIG. 10 shows a preferred embodiment of a speech enhancement method including dictionary extension.

In FIG. 10 is illustrated a preferred embodiment of a speech enhancement method 54 including dictionary extension. According to this embodiment of the inventive speech enhancement method 54 a generic speech model 56 and an adaptive noise model 58 are provided. Based on the reception of noisy speech 60, a noise gain and/or noise shape adaptation is performed, which is illustrated by block 62. Based on this adaptation 62 the noise model 58 is modified. The output of the noise gain and/or shape adaptation 62 is used in the noise estimation 64 together with the received noisy speech 60. Based on this noise estimation 60 the noisy speech is enhanced, whereby the output of the noise estimation 64 is enhanced speech 68. In order for the method to work fast and accurate with limited recourses a dictionary 70 that comprises a list 72 of typical noise models 74, 76, and 78. The list 72 of noise models 74, 76 and 78 are preferably typical known noise shape models. Based on a dictionary extension decision 80 it is determined whether to extend the list 72 of noise models with the modified noise model. This dictionary extension decision 80 is preferably based on a comparison of the modified noise model with the noise models 74, 76 and 78 in the list 72, and the dictionary extension decision 80 is preferably furthermore based on determining whether the difference between the modified noise model and the noise models in the list 72 is greater than a threshold. Before the dictionary extension decision 80, the noise gain 82 is, preferably separated from the modified noise model, whereby the dictionary extension decision 80 is solely based on the shape of the modified noise model. The noise gain 82 is used in the noise gain and/or shape adaptation 62. The provision of the noise model 58 may be based on an environment classification 84. Based on this environment classification 84 the noise model 74, 76, 78 that models the (noisy) environment best is chosen from the list 72. Since the noise models 74, 76, 78 in the list 72 preferably are shape models, only the shape of the (noisy) environment needs to be classified in order to select the appropriate noise model.

The generic speech model 56 may initially be trained and may even be trained on the basis of knowledge of the region from which a user of the inventive speech enhancement method is from. The generic speech model 56 may thus be customized to the region in which it is most likely to be used. Although the model 56 is described as a generic initially trained speech model, it should be understood that the speech model 56, may in another embodiment be adaptive, i.e. it may be modified dynamically based on the received noisy speech 60 and possibly also the modified noise model 58. Preferably the list 72 of noise models 74, 76, 78 are provided by initially training a set of noise models, preferably noise shape models.

The collection of operations or a subset of the collection of operations that are described above with respect to FIG. 10 is applied dynamically (though not necessarily for all the operations) to data entities (these data entities may for example be obtained from microphone measurements) and model entities. This results in a continuous stream of enhanced speech.

3E. Noise Shape Model Update

In this section, we discuss the estimation of the parameters of the noise shape model, θ. Estimation of the noise gain $\ddot{g}$ is briefly considered in the following section.

If low latency is not a critical requirement to the system the parameters can be estimated using all observed signal blocks of for example one sentence. The maximum likelihood estimate of the parameters is then defined as (Eq. 104):

$$\hat{\theta} = \underset{\theta}{\operatorname{argmax}} \max_{\ddot{g}} f(y_0^{N-1}|\theta, g_w),$$

where we write $y_0^n=\{y_\tau, \tau=0, \ldots, n\}$, $\ddot{g}$ is the sequence of the noise gains, and $\theta_x$ is the speech model. However, in real-time applications, low delay is a critical requirement, thus the aforementioned formulation is not directly applicable.

One solution to the problem may be based on the recursive EM algorithm (for example as described in D. M. Titterington, "Recursive parameter estimation using incomplete data", *J. Roy. Statist. Soc. B*, vol. 46, no 2, pp. 257-267, 1984, and V. Krishnamurthy and J. Moore, "On-line estimation of hidden Markov model parameters based on the Kullback-Leibler information measure", *IEEE Trans. Signal Processing*, vol. 41, no 8, pp. 2557-2573, August 1993, which is hereby incorporated by reference in its entirety.) using the stochastic approximation technique described in H. J. Kushner and G. G. Yin, "*Stochastic Approximation and Recursive Algorithms and Applications*", $2^{nd}$ ed. Springer Verlag, 2003, where the parameter update is performed for each observed data, recursively. Based on the stochastic approximation technique, the algorithm can be implemented without any additional delay.

Integral to the EM algorithm is the optimization of the auxiliary function. For our application, we use a recursive computation of the auxiliary function (Eq. 105):

$$Q_n(\theta|\hat{\theta}_0^{n-1}) = \int_{z_0^n \in Z_0^n} f(z_0^n|y_0^n; \hat{\theta}_0^{n-1}) \cdot \log(f(z_0^n, y_0^n; \theta, \hat{\theta}_0^{n-1}))dz_0^n,$$

where n denotes the index for the current signal block, $\hat{\theta}_0^{n-1}=\{\hat{\theta}\}_{j=0\ldots n-1}$ denotes the estimated parameters from the first block to the (n−1)'th block, z denotes the missing data and y denotes the observed noisy data. The missing data at block n, $z_n$, consists of the index of the state $s_n$, the speech gain $\bar{g}_n$, the noise gain and the noise $w_n$. $f(z_0^n, y_0^n; \theta, \hat{\theta}_0^{n-1})$ denotes the likelihood function of the complete data sequence, evaluated using the previously estimated model parameters $\hat{\theta}_0^{n-1}$ and the unknown parameter θ. The parameters $\hat{\theta}_0^{n-1}$ are needed to keep track on the state probabilities.

The optimal estimate of θ maximizes the auxiliary function $Q_n(\theta|\hat{\theta}_0^{n-1})$, where the optimality is in the sense of the maximum likelihood score, or alternatively the Kullback-Leibler measure. The estimator can be implemented using the stochastic approximation approach, with the update equation (Eq. 106):

$$\hat{\theta}_n=\hat{\theta}_{n-1}+I_n(\hat{\theta}_{n-1})^{-1}S_n(\hat{\theta}_{n-1}),$$

where (Eq. 107):

$$I_n(\hat{\theta}_{n-1}) = -\left[\frac{\partial^2 Q_n(\theta|\hat{\theta}_0^{n-1})}{\partial\theta^2}\right]_{\theta=\hat{\theta}_{n-1}}.$$

And (Eq. 108):

$$S_n(\hat{\theta}_{n-1}) = \left[\frac{\partial Q_n(\theta|\hat{\theta}_0^{n-1})}{\partial\theta}\right]_{\theta=\hat{\theta}_{n-1}}.$$

Following the derivation of V. Krishnamurthy and J. Moore, "On-line estimation of hidden Markov model parameters based on the Kullback-Leibler information measure", *IEEE Trans. Signal Processing*, vol. 41, no 8, pp. 2557-2573, August 1993, and skipping the details, we obtain the following update equation for the component variance of the $\ddot{s}$'th state and the k'th frequency bin (Eq. 109):

$$\hat{\sigma}_{\ddot{s}}^2[k]^{(n)} = \hat{\sigma}_j^2[k]^{(n-1)} + \Delta_n^\theta\left(E_{\ddot{s}}\left[|w[k]|^2|y_n|/\hat{\ddot{g}}_{\ddot{s}}^{(n)} - \hat{\sigma}_{\ddot{s}}^2[k]^{(n-1)}\right)\right.,$$

where (Eq. 110 – 112):

$$\Delta_n^\theta = \frac{\xi_n(s, \hat{\bar{g}}_n, \hat{\ddot{g}}_n)}{\sum_{t=0}^{n} \rho^{n-t}\xi_t(s, \hat{\bar{g}}, \hat{\ddot{g}}_t)}$$

$$\xi_t(s, \bar{g}_t, \ddot{g}_t) = Pr(s_t = s|y_0^n, \hat{\theta}_0^{t-1})f(\bar{g}_t|y_t; \hat{\theta}_{t-1}, s)f(\ddot{g}_t|y_t; \hat{\theta}_{t-1}, s)$$

$$\{\hat{\bar{g}}_t, \hat{\ddot{g}}_t\} = \underset{\bar{g}_t, \ddot{g}_t}{\operatorname{argmax}}\xi_t(s, \bar{g}_t, \ddot{g}_t).$$

That is, the update step size, $\Delta_n^\theta$, depends on the state probability given the observed data sequence, and the most likely pair of the speech and noise gains. The step size is normalized by the sum of all past ξ's, such that the contribution of a single sample decreases when more data have been observed. In addition, an exponential forgetting factor $0<\rho\leqq 1$ can be introduced in the summation of (Eq. 111), to deal with non-stationary noise shapes.

3F. Noise Gain Estimation

Given the noise shape model, estimation of the noise gain $$\hat{\bar{g}}_n$$

may also be formulated in the recursive EM algorithm. To ensure $$\hat{\bar{g}}_n$$

to be nonnegative, and to account for the human perception of loudness which is approximately logarithmic, the gradient steps are evaluated in the log domain. The update equation for the noise gain estimate $$\hat{\hat{g}}_n$$

can be derived similarly as in the previous section.

We propose different forgetting factors in the noise gain update and in the noise shape model update. We assume that the spectral contents of the noise of one particular noise environment can be well modeled using a mixture model, so the noise shape model parameters vary slowly with time. The noise gain would, however, change more rapidly, due to, e.g., the movement of the noise source.

3G. Experimental Results

In this section, we demonstrate the advantage of the proposed noise gain/shape estimation algorithms described in section 3E and 3F in non-stationary noise environments. In the first experiment, we estimate a noise shape model in a highly non-stationary noise (car+siren noise) environment. In the second experiment, we show the noise energy tracking ability using an artificially generated noise. The first experiment is performed using a recorded noise inside a police vehicle, with highly non-stationary siren noise in the background. We compare the noise shape model estimation algorithm with one of the state-of-the-art noise estimation algorithm based on minimum statistics with bias compensation (disclosed in R. Martin, "Noise power spectral density estimation based on optimal smoothing and minimum statistics", *IEEE Trans. Speech and Audio Processing,* vol. 9, no 5, pp. 504-512, July 2001). In both cases, the tests are first performed using car noise only, such that the noise shape model/buffer are initialized for the car noise. By changing the noise to the car+siren noise, we simulate for the case when the environment changes. Both methods are supposed to adapt to this change with some delay. The true siren noise consists of harmonic tonal components of two different fundamental frequencies, that switches an interval of approximately 600 ms. In one state, the fundamental frequency is approximately 435 Hz and the other is 580 Hz. In the short-time spectral analysis with 8 kHz sampling frequency and 32 ms blocks, these frequencies corresponds to the 14'th and 18'th frequency bin.

Figure 11:
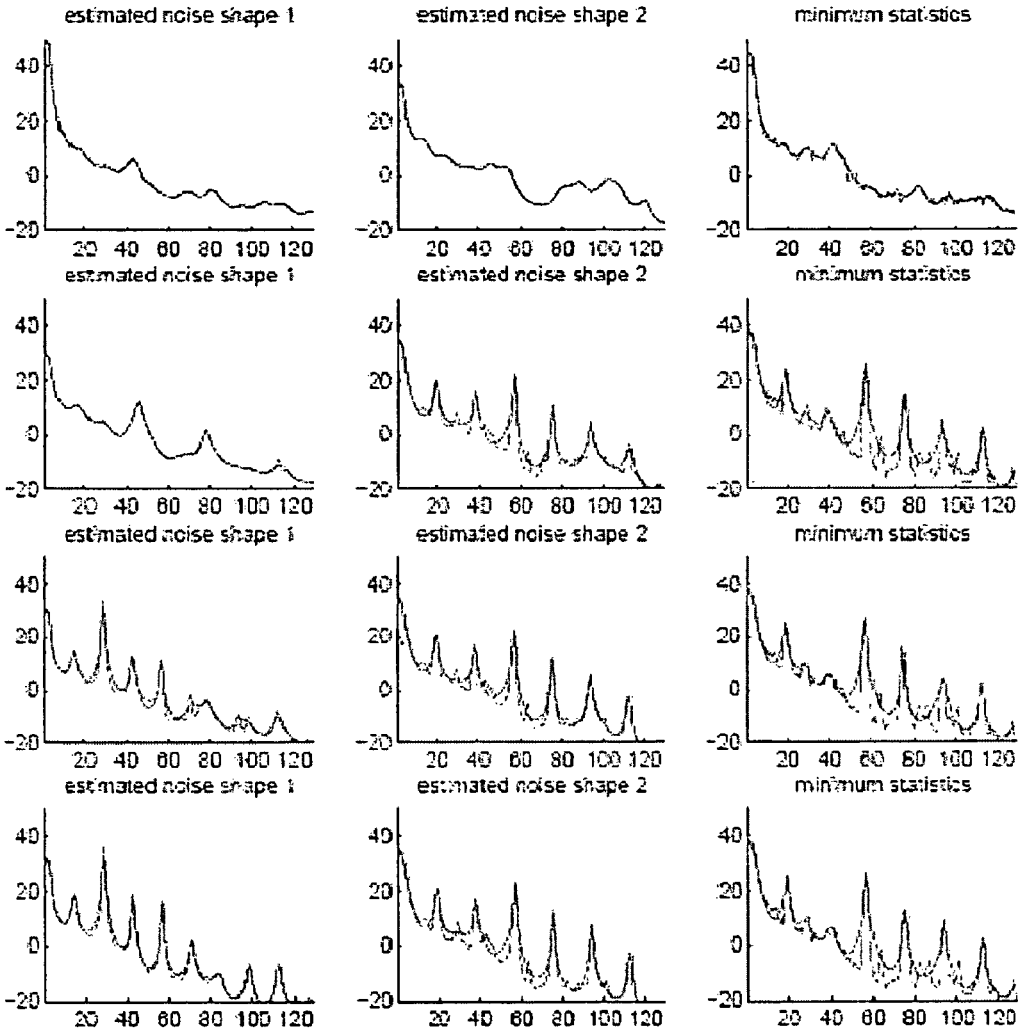
FIG. 11 shows a comparison between an estimated noise shape model and the estimated noise power spectrum using minimum statistics.

The noise shapes from the estimated noise shape model and the reference method are plotted in FIG. 11. The plots are shown with approximately 3 seconds' interval in order to demonstrate the adaptation process. The first row shows the noise shapes before siren noise has been observed. After 3 seconds' of siren noise, both methods start to adapt the noise shapes to the tonal structure of the siren noise. After 6-9 seconds, the proposed noise shape estimation algorithm has discovered both states of the siren noise. The reference method, on the other hand, is not capable of estimating the switching noise shapes, and only one state of the siren noise is obtained. Therefore, the enhanced signal using the reference method has high level of residual noise left, while the proposed method can almost completely remove the highly non-stationary noise.

3H. Updating and Augmenting the Dictionary

For rapid reaction to novel (but already familiar) environmental modes, we store a set of typical noise models in a dictionary, such as the list 42 or 72 of noise models shown in FIG. 9 or FIG. 10. When the current (continuously adapted) noise model is too dissimilar from any model in the dictionary (42 or 72) and informative enough for future reuse, we add the current model to the dictionary (42 or 72). The Dictionary Extension Decision (DED) unit 80 will take care of this decision. As an example, the following criteria may be used the DED (Eq. 113):

$$D(y_n, \theta_{w_n}) = \alpha D(y_{n-1}, \theta_{w_{n-1}}) + (1-\alpha)\left\|\left[\frac{\partial Q_n(\theta|\hat{\theta}_0^{n-1})}{\partial \theta}\right]_{\theta=\hat{\theta}_{w_{q-1}}}\right\|^2.$$

Based on the norm of the gradient vector, $D(y_n, \theta_{w_n})$ is a measure on the change of the likelihood with respect to the noise model parameters, and alpha is here a smoothing parameter. We remark that this criterion is by no means an exhaustive description what might be employed by the DED unit 80.

3I. Environmental Classification

From the dictionary 72 shown in FIG. 10, the environmental classification (EC) unit 84 selects the one of the noise models 74, 76, 78, which best describes the current noise environment. The decision can be made upon the likelihood score for a buffer of data (Eq. 114):

$$\hat{c} = \underset{c}{\operatorname{argmax}} f(y_{n-J}^n; \theta^c),$$

where the noise model which maximizes the likelihood is selected. We remark that this criterion is by no means an exhaustive description what might be employed by the EC unit 84.

Figure 12:
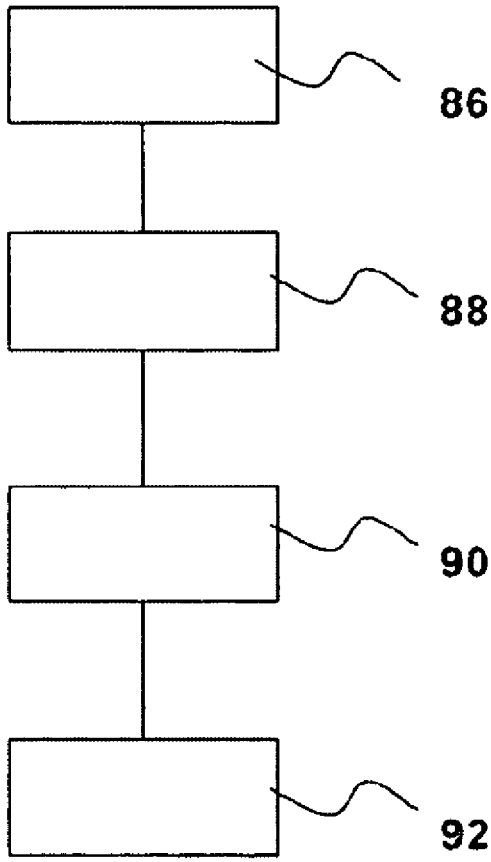
FIG. 12 shows a block diagram of a method of speech enhancement based on a novel cost function.

In FIG. 12 is shown a simplified block diagram of a method of speech enhancement based on a novel cost function. The method comprises the step 86 of receiving noisy speech comprising a clean speech component and a noise component, the step 88 of providing a cost function, which cost function is equal to a function of a difference between an enhanced speech component and a function of clean speech component and the noise component, the step 90 of enhancing the noisy speech based on estimated speech and noise components, and the step 92 of minimizing the Bayes risk for said cost function in order to obtain the clean speech component.

Figure 13:
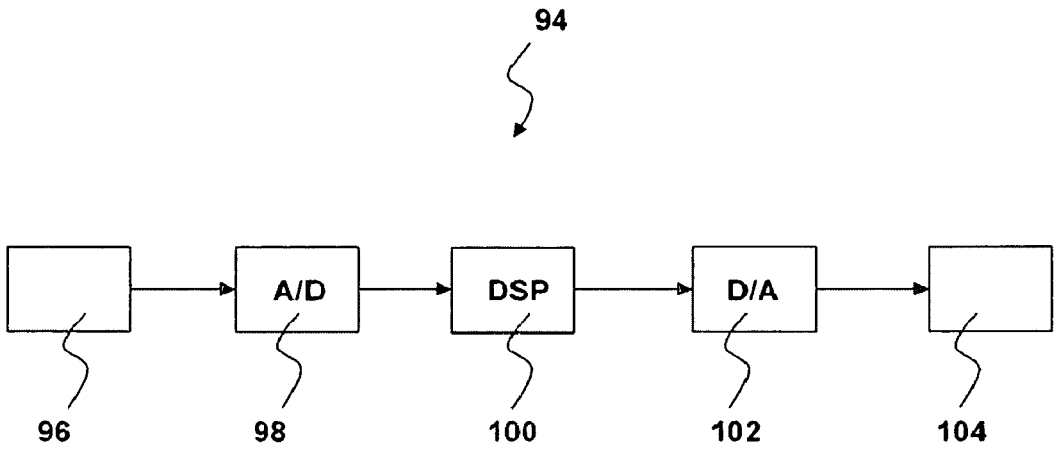
FIG. 13 shows a simplified block diagram of a hearing system, which hearing system is embodied as a hearing aid.

In FIG. 13 is shown a simplified block diagram of a hearing system, which hearing system in this embodiment is a digital hearing aid 94. The hearing aid 94 comprises an input transducer 96, preferably a microphone, an analogue-to-digital (A/D) converter 98, a signal processor 100 (e.g. a digital signal processor or DSP), a digital-to-analogue (D/A) converter 102, and an output transducer 104, preferably a receiver. In operation, input transducer 96 receives acoustical sound signals and converts the signals to analogue electrical signals. The analogue electrical signals are converted by A/D converter 98 into digital electrical signals that are subsequently processed by the DSP 100 to form a digital output signal. The digital output signal is converted by D/A converter 102 into an analogue electrical signal. The analogue signal is used by output transducer 104, e.g., a receiver, to produce an audio signal that is adapted to be heard by a user of the hearing aid 94. The signal processor 100 is adapted to process the digital electrical signals according to a speech enhancement method (which method is described in the preceding sections of the specification). The signal processor 100 may furthermore be adapted to execute a method of maintaining a list of noise models, as described with reference to FIG. 9. Alternatively, the signal processor 100 may be adapted to execute a method of speech enhancement and maintaining a list of noise models, as described with reference to FIG. 10.

The signal processor 100 is further adapted to process the digital electrical signals from the A/D converter 98 according to a hearing impairment correction algorithm, which hearing impairment correction algorithm may preferably be individually fitted to a user of the hearing aid 94.

The signal processor 100 may even be adapted to provide a filter bank with band pass filters for dividing the digital signals from the A/D converter 98 into a set of band pass filtered digital signals for possible individual processing of each of the band pass filtered signals.

It is understood that the hearing aid 94 may be a in-the-ear, ITE (including completely in the ear CIE), receiver-in-the-ear, RIE, behind-the-ear, BTE, or otherwise mounted hearing aid.

Figure 14:
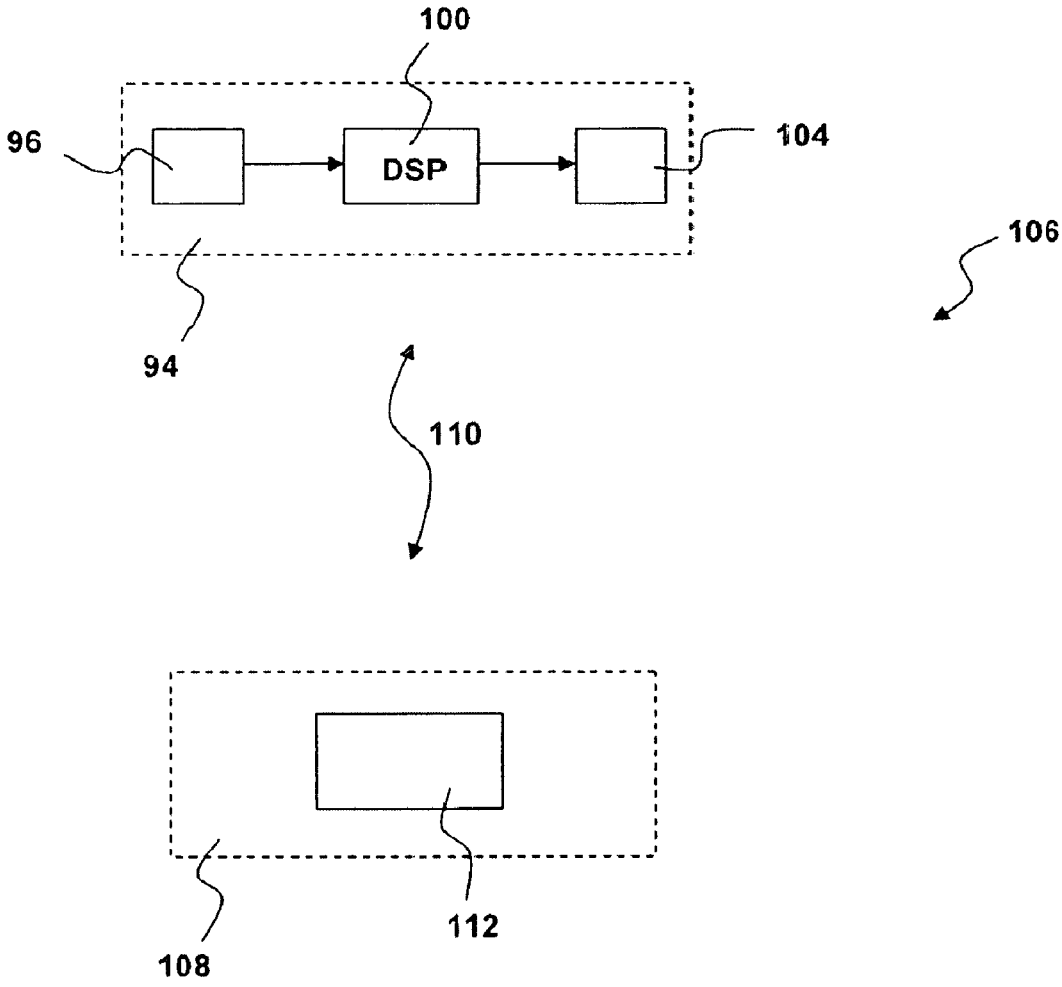
FIG. 14 shows a simplified block diagram of a hearing system comprising a hearing aid and a portable personal device.

In FIG. 14 is shown a simplified block diagram of a hearing system 106, which system 106 comprises a hearing aid 94 and a portable personal device 108. The hearing aid 94 and the portable personal device 108 are linked to each other through the link 110. Preferably the hearing aid 94 and the portable personal device 108 are operatively linked to each other through the link 110. The link 110 is preferably wireless, but may in an alternative embodiment be wired, e.g. through an electrical wire or a fiber-optical wire. Furthermore, the link 110 may be bidirectional, as is indicated by the double arrow.

According to this embodiment of the hearing system 106 the portable personal device 108 comprises a processor 112 that may be adapted execute a method of maintaining a list of noise models, for example as described with reference to FIG. 9 or FIG. 10 including dictionary extension (maintenance of a list of noise models). In one preferred embodiment the noisy speech is received by the microphone 96 of the hearing aid 94 and is at least partly transferred, or copied, to the portable personal device 108 via the link 110, while at substantially the same time at least a part of said input signal is further processed in the DSP 100. The transferred noisy speech is then processed in the processor 112 of the portable personal device 108 according to the block diagram shown in FIG. 9 of updating a list of noise models. This updated list of noise models may then be used in a method of speech enhancement according to the previous description. The speech enhancement is preferably performed in the hearing aid 94. In order to facilitate fast adaptation to changing noisy conditions the gain adaptation (according to one of the algorithms previously described) is performed dynamically and continuously in the hearing aid 94, while the adaptation of the underlying noise shape model(s) and extension of the dictionary of models is performed dynamically in the portable personal device 108. In a preferred embodiment of the hearing system 106 the dynamical gain adaptation is performed on a faster time scale than the dynamical adaptation of the underlying noise shape model(s) and extension of the dictionary of models. In yet another embodiment of the hearing system 106 the adaptation of the underlying noise shape model(s) and extension of the dictionary of models is initially performed in a training phase (off-line) or periodically at certain suitable intervals. Alternatively, the adaptation of the underlying noise shape model(s) and extension of the dictionary of models may be triggered by some event, such as a classifier output. The triggering may for example be initiated by the classification of a new sound environment. In an even further embodiment of the inventive hearing system 106, also the noise spectrum estimation and speech enhancement methods may be implemented in the portable personal device.

As illustrated above, noisy speech, enhancement based on a prior knowledge of speech and noise (provided by the speech and noise models) is feasible in a hearing aid. However, as will be understood by those familiar in the art, the present embodiments may be embodied in other specific forms and utilize any of a variety of different algorithms without departing from the spirit or essential characteristics thereof. For example the selection of an algorithm is typically application specific, the selection depending upon a variety of factors including the expected processing complexity and computational load. Accordingly, the disclosures and descriptions herein are intended to be illustrative, but not limiting, of the scope of the invention which is set forth in the following claims.

The invention claimed is:

1. A method of enhancing speech, comprising:

receiving noisy speech comprising a clean speech component and a non-stationary noise component;

providing a speech model;

providing a noise model having at least one shape and a gain;

dynamically modifying the at least one shape and the gain of the noise model based at least in part on the speech model and the received noisy speech using a processor; and enhancing the noisy speech at least based on the modified noise model.

2. The method of claim 1, wherein the at least one shape and gain of the noise model are respectively modified separately.

3. The method of claim 1, wherein the gain of the noise model is dynamically modified at a higher rate than the at least one shape of the noise model.

4. The method of claim 1, wherein the noisy speech enhancement is further based on the speech model.

5. The method of claim 1, further comprising estimating the noise component based on the modified noise model, wherein the noisy speech is enhanced based on the estimated noise component.

6. The method of claim 5, further comprising estimating the speech component based on the speech model, wherein the noisy speech is enhanced further based on the estimated speech component.

7. The method of claim 1, further comprising estimating the speech component based on the speech model, wherein the noisy speech is enhanced based on the estimated speech component.

8. The method of claim 1, further comprising the steps of dynamically modifying the speech model based on the noise model and the received noisy speech and enhancing the noisy speech based on the modified speech model.

9. The method of claim 1, wherein the noise model is a hidden Markov model (HMM).

10. The method of claim 9, wherein the HMM is a Gaussian mixture model.

11. The method of claim 1, wherein the noise model is derived from at least one code book.

12. The method of claim 1, wherein providing the noise model comprises selecting one of a plurality of noise models based on the non-stationary noise component.

13. The method of claim 1, wherein the dynamic modification of the noise model, the noise component estimation, and the noisy speech enhancement are repeatedly performed.

14. The speech enhancement system of claim 13, further being adapted to be used in a hearing system.

15. The speech enhancement system of claim 13, wherein the signal processor is configured to modify the at least one shape and the gain of the noise model in real time.

16. The speech enhancement system of claim 13, wherein the signal processor is configured to modify the at least one shape and the gain of the noise model without confinement to a speech pause.

17. The method of claim 1, wherein the act of dynamically modifying the at least one shape and the gain of the noise model comprises modifying the at least one shape and the gain of the noise model is performed in real time.

18. The method of claim 1, wherein the act of dynamically modifying the at least one shape and the gain of the noise model comprises modifying the at least one shape and the gain of the noise model is performed without confinement to a speech pause.

19. A speech enhancement system comprising:

a speech model;

a noise model having at least one shape and a gain;

a microphone for the provision of an input signal based on the reception of noisy speech, which noisy speech comprises a clean speech component and a non-stationary noise-component;

a signal processor configured to modify the at least one shape and the gain of the noise model based at least in part on the speech model and the input signal, and enhancing the noisy speech on the basis of the modified noise model in order to provide a speech enhanced output signal, wherein the signal processor is further adapted to perform the modification of the noise model dynamically.

* * * * *